US012679687B2

(12) United States Patent
Kotaka

(10) Patent No.: US 12,679,687 B2
(45) Date of Patent: Jul. 14, 2026

(54) MEDIUM STACKING DEVICE, PRINTING SYSTEM, AND CONTROL METHOD OF MEDIUM STACKING DEVICE

(71) Applicant: SEIKO EPSON CORPORATION, Tokyo (JP)

(72) Inventor: Toshikazu Kotaka, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 227 days.

(21) Appl. No.: 18/442,616

(22) Filed: Feb. 15, 2024

(65) Prior Publication Data

US 2024/0279018 A1 Aug. 22, 2024

(30) Foreign Application Priority Data

Feb. 17, 2023 (JP) ..... 2023-023222

(51) Int. Cl.
*B65H 31/34* (2006.01)
*B65H 31/10* (2006.01)
*B65H 43/04* (2006.01)

(52) U.S. Cl.
CPC ..... *B65H 31/34* (2013.01); *B65H 31/10* (2013.01); *B65H 43/04* (2013.01); *B65H 2404/7412* (2013.01); *B65H 2406/10* (2013.01); *B65H 2601/111* (2013.01)

(58) Field of Classification Search
CPC ..... B65H 43/04; B65H 31/10; B65H 31/20; B65H 31/34; B65H 31/36; B65H 2601/111; B65H 2406/10; B65H 2406/121; B65H 2301/36; B65H 2301/363; B65H 2404/7412; B65H 2404/743
USPC ..... 270/58.17, 58.27
See application file for complete search history.

(56) References Cited

U.S. PATENT DOCUMENTS 9,926,153 B2 * 3/2018 Kubota ..... B65H 43/04
11,479,435 B2 * 10/2022 Takahashi ..... B65H 31/10

FOREIGN PATENT DOCUMENTS

JP 2021080091 B2 5/2021

* cited by examiner

*Primary Examiner* — Leslie A Nicholson, III
(74) *Attorney, Agent, or Firm* — CHIP LAW GROUP

(57) ABSTRACT

The medium stacking device 30 includes a stacking platform 31 on which the image printed medium M can be placed, a movable fence MF that moves between a restriction position that restricts the edge portion of the medium M to be discharged toward the stacking platform 31 and a retreat position retreated from the restriction position, and the control section 93 that performs the control to move the movable fence MF from the restriction position to the retreat position and back to the restriction position when a placement defect of the medium M on the stacking platform 31 is detected, wherein the control section 93 determines the movement amount MA from the restriction position to the retreat position based on the medium information of the medium M and the printing information of the image.

10 Claims, 17 Drawing Sheets

| | | PAPER TYPE | | |
|---|---|---|---|---|
| | | A | B | C |
| PRINT DUTY | < 40% | d1 | d2 | d3 |
| | 40% ≤ | d4 | d5 | d6 |

MEDIUM STACKING DEVICE, PRINTING SYSTEM, AND CONTROL METHOD OF MEDIUM STACKING DEVICE

The present application is based on, and claims priority from JP Application Serial Number 2023-023222, filed Feb. 17, 2023, the disclosure of which is hereby incorporated by reference herein in its entirety.

BACKGROUND

1. Technical Field

The present disclosure relates to a medium stacking device, a printing system, and a control method of the medium stacking device.

2. Related Art

JP-A-2021-80091 discloses a medium discharge device including a stacking platform, a movable fence, and a control section. The medium discharge device is an example of the medium stacking device. The movable fence moves between a restriction position, where the movable fence restricts the medium that is discharged toward the stacking platform, and a retreat position, where the movable fence is retreated from the restriction position. Note that the medium being discharged toward the stacking platform is printed by a inkjet head. When the control section detects that the medium is leaning against the movable fence, the control section moves the movable fence from the restriction position to the retreat position and returns it to the restriction position, to resolve leaning of the medium against the movable fence. Further, it is disclosed that the control section adjusts a movement amount of the movable fence from the restriction position to the retreat position based on the discharge medium information of the medium being discharged toward the stacking platform. It is also disclosed that the discharge medium information is at least one of the following: medium size, basis weight, paper quality including friction coefficient, discharge speed, discharge interval, and the like. The discharge medium information is an example of medium information of a medium which is discharged toward the stacking platform.

When printing is performed by ejecting ink onto the medium, the friction coefficient and other properties of the medium may change, or the medium may deform, depending on the specifications of the print medium. If the characteristics of the medium change or the medium is deformed, conditions of the placement defect of the medium on the stacking platform, including leaning of the medium against the movable fence, will change. Therefore, simply adjusting the movement amount of the movable fence from the restriction position to the retreat position based on the discharge medium information, as in JP-A-2021-80091, may not be sufficient to resolve leaning of the medium against the movable fence. As a result, there is a possibility that stacking disorder of medium may occur on the stacking platform.

SUMMARY

A medium stacking device includes a stacking platform that is configured to have stacked thereon a medium on which an image is printed by ejecting liquid; a movable fence that moves between a restriction position that restricts the edge portion of the medium that was discharged toward the stacking platform, and a retreat position retreated from the restriction position; and a control section that, when a placement defect of the medium is detected in the stacking platform, performs control to move the movable fence from the restriction position to the retreat position and to return the movable fence to the restriction position, wherein the control section determines a movement amount from the restriction position to the retreat position based on medium information of the medium and printing information of the image.

A printing system includes the medium stacking device that stacks the medium on which the image is printed; and a printing device that prints the image by ejecting liquid onto the medium.

The control method of the medium stacking device including a stacking platform that is configured to stack a medium on which an image is printed by ejecting liquid and a movable fence that moves between a restriction position that restricts the edge portion of the medium that was discharged toward the stacking platform, and a retreat position retreated from the restriction position, the control method of a medium stacking device includes confirming whether or not there is a placement defect of the medium being stacked on the stacking platform; determining a movement amount from the restriction position to the retreat position based on medium information of the medium and printing information of the image, when the placement defect of the medium is detected; and moving the movable fence from the restriction position to the retreat position, and returning the movable fence to the restriction position, based on the determined movement amount.

DESCRIPTION OF EMBODIMENTS

Figure 1:
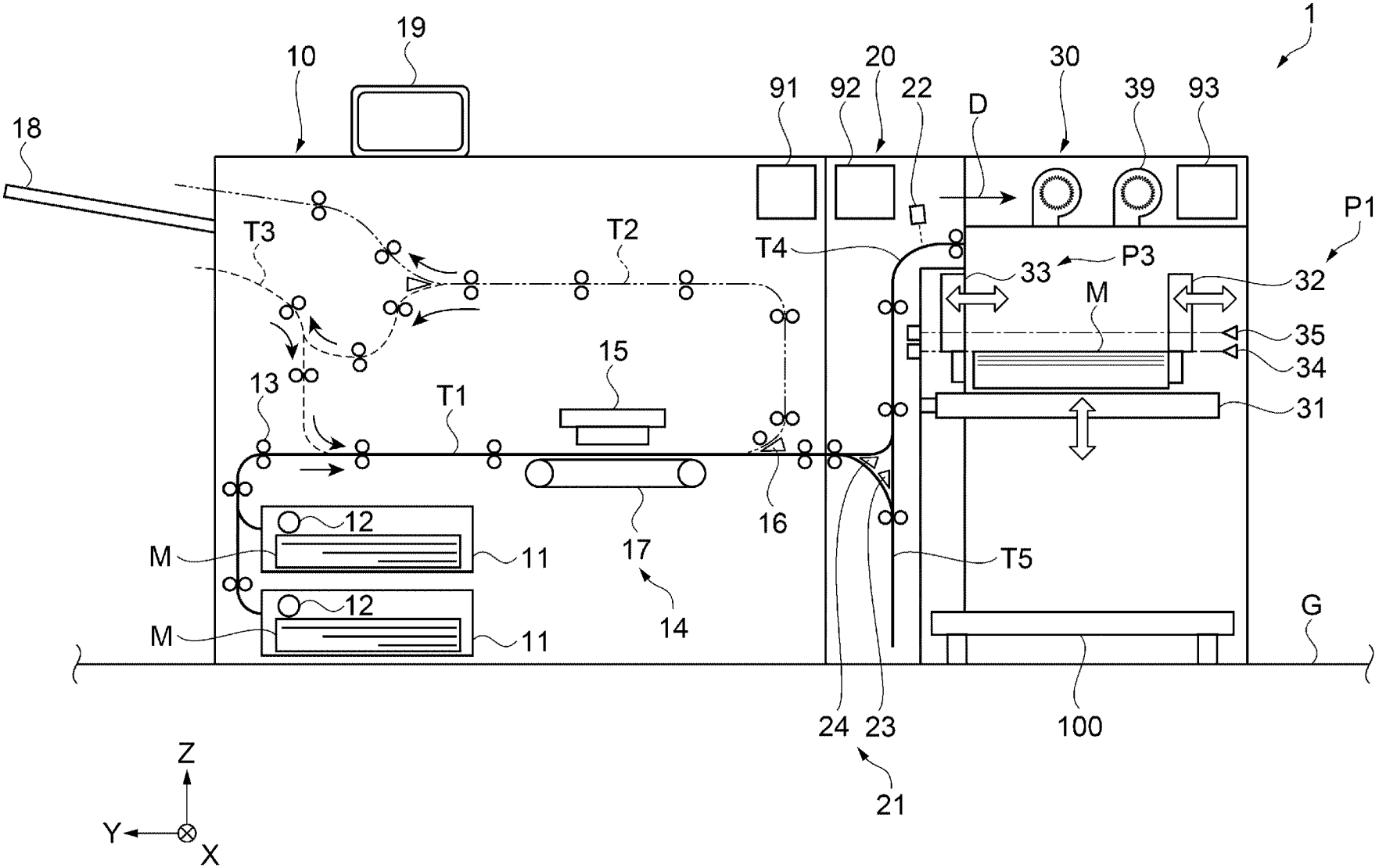
FIG. 1 is a schematic diagram showing a printing system.

Hereinafter, this disclosure will be described based on embodiments. In each figure, the same symbol is used for the same members, and redundant explanations are omitted. Note that in this specification, "same", "identical", and "simultaneous" do not refer only to being exactly the same. For example, in this specification, "same", "identical", and "simultaneous" shall include cases where they are the same, taking into account measurement error.

Further, for example, in this specification, "same", "identical", and "simultaneous" shall include cases where they are the same, taking into account manufacturing variations of members. Further, for example, in this specification, "same", "identical", and "simultaneous" shall include cases where they are the same without loss of function. Thus, for example, "both dimensions are the same" means that a dimensional difference between the two is within +5%, and especially preferably within +3% of one of the dimensions, taking account measurement errors and manufacturing variations of the members.

1. First Embodiment

In this embodiment, the printing system 1 is an inkjet printer that performs printing by ejecting ink, which is an example of a liquid, onto a medium M, which is an example of a sheet of paper such as print paper.

Note that X, Y, and Z in each figure represent three spatial axes that are orthogonal to each other. In this specification, directions along these axes are an X-axis direction, a Y-axis direction, and a Z-axis direction. When specifying the direction, a positive direction is denoted by "+" and a negative direction is denoted by "−". The positive and negative signs are used together in the direction notation, and the direction to which the arrow in each figure is pointing is described as the + direction and the direction opposite to the arrow is described as the − direction.

The Z-axis direction indicates the gravity direction with the +Z direction indicates the vertically upward direction, and the −Z direction indicates the vertically downward direction. A plane containing the X and Y axes is described as an X-Y plane, a plane containing the X and Z axes is described as an X-Z plane, and a plane containing the Y and Z axes is described as a Y-Z plane. The X-Y plane is a horizontal plane. Then, the three X, Y, and Z spatial axes, which do not limit the positive and negative directions, are described as the X-axis, the Y-axis, and the Z-axis.

The X-axis direction is a depth direction of a device and is a width direction of a medium. In the X-axis direction, the +X direction is a direction from a front surface of the device toward a rear surface of the device, and the −X direction is a direction from the rear surface of the device toward the front surface of the device.

The Y axis direction is a width direction of a printing system 1, a printing device 10, an intermediate transport device 20, and a medium stacking device 30. When viewing the printing system 1 from the front surface side, the +Y direction is the left and the −Y direction is the right. The front surface of the printing system 1 is a surface where an operation section 19 is located, which is operated by the user to give instructions to the printing system 1.

The Z-axis direction is a normal direction with respect to an installation surface G, on which the printing system 1, the printing device 10, the intermediate transport device 20, and the medium stacking device 30 are installed. Therefore, the Z-axis direction is a height direction of the printing system 1, the printing device 10, the intermediate transport device 20, and the medium stacking device 30.

Hereinafter, in a transport direction of the medium M indicated by an arrow in each drawing, a direction in which the medium M is transported may be referred to as "downstream", and a direction opposite thereto may be referred to as "upstream". FIG. 1 shows a printing path T1 of the medium M in the printing device 10, a discharge path T4 of the medium M in the intermediate transport device 20, and an inversion path T5 in solid line. FIG. 1 also shows the circulation path T2 of the medium M in the printing device 10 in double-dotted lines, and also shows the inversion path T3 in the printing device 10 in broken line.

As shown in FIG. 1, the printing system 1 is equipped with the printing device 10, the intermediate transport device 20, and the medium stacking device 30. The intermediate transport device 20 is provided at an adjacent position that is in the −Y direction side of the printing device 10. The medium stacking device 30 is provided at an adjacent position that is in the −Y direction side of the intermediate transport device 20. Note that although the printing device 10, the intermediate transport device 20, and the medium stacking device 30 are located separately, the printing system 1 may be equipped with the printing device 10, the intermediate transport device 20, and the medium stacking device 30 as a single unit. In this case, the printing system 1 is an example of a recording device that performs recording on the medium M.

Figure 2:
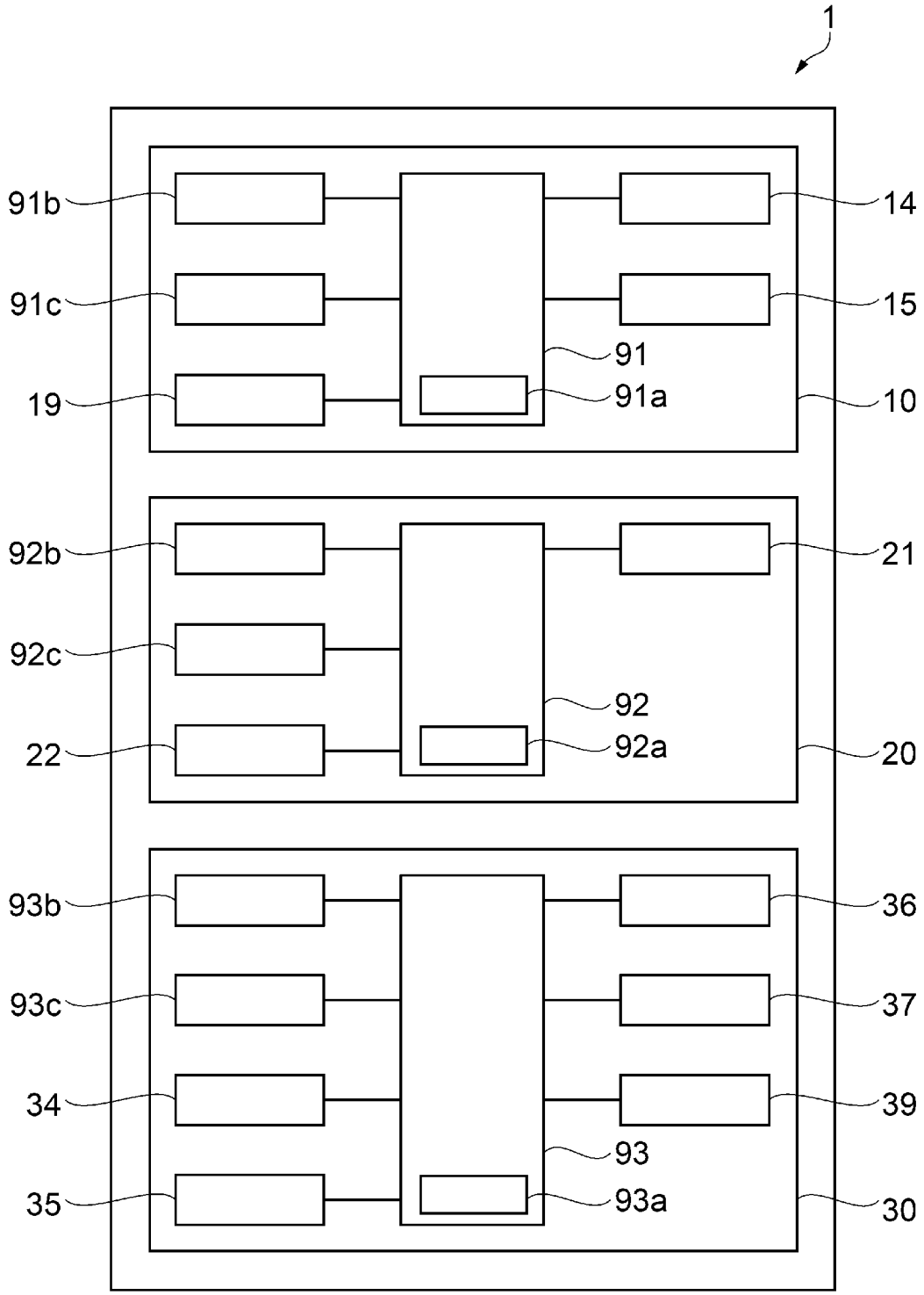
FIG. 2 is a block diagram showing an electrical configuration of the printing system.

As shown in FIG. 1, the printing device 10 is equipped with medium accommodation sections 11, a transport section 14, a printing section 15, a discharge section 18, the operation section 19, and a control section 91. The transport section 14 includes pickup rollers 12, a plurality of transport roller pairs 13, a suction transport section 17, and a guide flap 16. The printing device 10 has the printing path T1, the circulation path T2, and the inversion path T3, through which the medium M is transported. Further, as shown in FIG. 2, the printing device 10 is equipped with a storage section 91*b* and an interface section 91*c*.

As shown in FIG. 1, the medium accommodation sections 11 accommodate the medium M. The medium accommodation sections 11 are cassette type accommodation sections that can accommodate medium M in a stacked state. The printing device 10 is provided with at least one (two in FIG. 1) medium accommodation sections 11, which can be attached to and detached from the −X direction side of the printing device 10.

The pickup roller 12 feeds out and transports the topmost medium M among the plurality of sheets of the medium M stacked in the medium accommodation sections 11.

The plurality of the transport roller pairs 13 are located in each of the printing path T1, the circulation path T2, and the inversion path T3 in the printing device 10, and transport the medium M while nipping the medium M.

The suction transport section 17 is located facing the printing section 15. The suction transport section 17 transports the medium M by a transport belt while sucking the medium M. The suction transport section 17 has a driving pulley and a driven pulley, and the transport belt is wound around these pulleys. The suction transport section 17 may be a suction transport mechanism that uses suction force from a suction fan to suck the medium M onto a support surface of the transport belt.

The printing section 15 prints an image by ejecting ink, which is supplied from an ink tank (not shown), onto the medium M. The printing section 15 is equipped with an inkjet head. The inkjet head is capable of ejecting a water-based ink, which uses water as a main solvent, and an oil-based ink, which uses organic solvent as a main solvent. The printing section 15 is located on the +Z direction side of the transport belt of the suction transport section 17, and in the Z-axis direction, the printing section 15 is located facing the transport belt with the printing path T1 between them. The printing section 15 deposits ink onto the medium M supported on and transported the transport belt, by ejecting ink from the inkjet head based on the print data. By this, an image based on the print data is formed on the medium M.

The printing section 15 in this embodiment is a so-called a line head which can eject ink simultaneously over the width direction of the medium M, which is the X-axis direction. The print data is data that is generated based on an image data to be printed on the medium M, and that is used to cause the printing section 15 to perform printing by ejecting ink. The image data includes text data and picture data. Note that the printing section 15 may be a so-called serial head that ejects ink onto the medium M while moving in the X-axis direction.

The guide flap 16 is provided at a position where the transport path branches into the printing path T1 and the circulation path T2, and at a position where the transport path branches into the circulation path T2 and the inversion path T3. At the point where the transport path branches into the printing path T1 and circulation path T2, the guide flap 16 switches the transport path of medium M between the printing path T1, which leads to intermediate transport device 20, and the circulation path T2, which leads to the discharge section 18 or inversion path T3. At the point where the transport path branches into the circulation path T2 and the inversion path T3, the guide flap 16 switches the transport path of the medium M between the transport path that leads to the discharge section 18 and the transport path that leads to the inversion path T3. Note that in the inversion path T3, the medium M is inverted and is transported again to the printing section 15.

The discharge section 18 is a tray extending in the +Y direction from a housing of the printing device 10. The medium M that is not discharged to the medium stacking device 30 is stacked in the discharge section 18.

The operation section 19 is located above the side surface of the printing device 10 in the −X direction side, which is the front surface of the housing. The operation section 19 has a display section comprising a touch panel. The user can give instructions to the printing system 1 by touching the display section. Note that the operation section 19 may have operation buttons. The operation section 19 is an example of an information acquisition section.

As shown in FIG. 2, the control section 91 has a central processing unit (CPU) 91*a* that functions as a calculation processing unit to control the operation of the entire printing device 10, and controls the operation of the transport section 14, printing section 15, and other sections. The control section 91 can control the transport section 21 of the intermediate transport device 20 in conjunction with the control section 92 of the intermediate transport device 20 (to be described later). The control section 91 can also control a stacking platform drive section 36, a fence drive section 37, and a fan 39 of the medium stacking device 30 in conjunction with a control section 93 of the medium stacking device 30 (to be described later).

The storage section 91*b* has, for example, a read only memory (ROM), a random access memory (RAM), and the like. The ROM is a read-only semiconductor memory in which a predetermined control program is prerecorded. The RAM is a semiconductor memory that can be written and read at any time and is used as a working storage region as needed when the CPU 91*a* executes various control programs.

The interface section 91*c* transfers various types of information to and from the intermediate transport device 20 and the medium stacking device 30. The interface section 91*c* is an example of the information acquisition section. For example, the interface section 91*c* sends to the medium stacking device 30 the printing information of the image, which is obtained from a print job, and the medium information, which is the information of the medium M on which the image is printed.

The printing information of the image and the medium information of the medium M include the print job that is input by the user from the operation section 19, or information generated or calculated from the print job. The medium information includes, for example, a paper type, size, basis weight, paper quality including friction coefficient, transport speed, discharge speed, and discharge interval of the medium M on which the image is printed. If the transport speed, discharge speed, and discharge interval of the medium M are not input through the operation section 19, they are determined by the control section 91 based on at least one of the paper type, basis weight, and paper quality of the medium M. Note that the paper quality of the medium M, including the basis weight and the friction coefficient, may be included in the paper type of the medium M.

The printing information includes, for example, print quality, data of the image to be printed, print size of the image, print data, print duty, and whether double-sided printing is selected. The print data is data that causes the printing section 15 to eject ink to form an image on the medium M. The print data is data generated by the control section 91 based on the image data to be printed on medium M, the print size of the image, and the print quality.

The print duty is density of ink applied to medium M and is a value calculated by the following formula.

$$\text{Print duty}[\%]=\text{number of dots actually recorded}/(\text{vertical resolution}\times\text{horizontal resolution})\times 100$$

In the formula, "the number of dots actually recorded" is the actually recorded number of dots per unit area formed by ink droplets, and "vertical resolution" and "horizontal resolution" are the resolution of each per unit length in the medium M. The print duty is data that is calculated from the print data generated by the control section 91. The print duty may be calculated by the control section 91 or may be calculated by the control section 93 of the medium stacking device 30 (to be described later) using the print data obtained from the control section 91.

When printing the image data on the medium M, the amount of ink applied to the surface of the medium M on which the image data is to be printed changes depending on the print duty. The higher the print duty, the more ink is applied to the surface of the medium M on which the image data is printed.

When printing the image data on the medium M, the friction coefficient of the medium M also changes as the amount of ink applied to the medium M changes. As the amount of ink applied to the medium M increases, the sliding property of the medium M decreases. In other words, the higher the print duty, the lower the sliding property of the medium M. For example, when the medium M is a general printing paper composed mainly of cellulose, a noticeable decrease in the sliding property of the medium M appears when the print duty is higher than 40%.

When printing the image data onto the medium M, the degree of deformation and the state of deformation of the medium M will differ as the amount of ink applied to the medium M changes. For example, when the medium M is a general printing paper composed mainly of cellulose, curl is noticeable when the difference in the print duty between the front surface and back surface of the medium M is higher than 30%. The above-mentioned changes in the sliding property of medium M, the curl of the medium M, and other deformations are more likely to be noticeable when printing with a water-based ink, such as the ink in this embodiment, where the main solvent of the ink is water. Further, as described above, changes in the sliding property of the medium M and deformation of medium M, such as curling, are more likely to be noticeable when printing with a water-based ink containing higher than 50 mass % water.

The printing information also includes control information on whether printing on the medium M is double-sided printing or single-sided printing. Curl is also noticeable in single-sided printing because of the significant difference in print duty on the front and back surfaces of the print medium M.

As shown in FIG. 1, the intermediate transport device 20 is equipped with a transport section 21, a medium passing detection sensor 22, and the control section 92. The transport section 21 includes a plurality of transport roller pairs 23 and guide flaps 24. The intermediate transport device 20 has the discharge path T4, through which the medium M is transported, and the inversion path T5. As shown in FIG. 2, the intermediate transport device 20 is equipped with a storage section 92*b* and an interface section 92*c*.

A plurality of transport roller pairs 23 are provided in the discharge path T4 and the inversion path T5. The plurality of transport roller pairs 23 transports the medium M discharged from the printing device 10 while nipping the medium M.

The guide flap 24 is provided at the position where the transport path branches into the discharge path T4 and the inversion path T5, and at the position where the transport path goes from the inversion path T5 to the discharge path T4. At the position where the transport path branches into the discharge path T4 and the reversal path T5, the guide flap 24 switches the transport path of the medium M between the discharge path T4, which leads to the medium stacking device 30, and the inversion path T5, which inverts the medium M. At the position where the transport path goes from the inversion path T5 to the discharge path T4, the guide flap 24 guides the medium M toward the discharge path T4, which leads to the medium stacking device 30. Note that when inverting the front and back surfaces of the medium M transported from the printing device 10, the medium M is transported to the inversion path T5 to invert front and back surfaces.

The medium passing detection sensor 22, for example, has a light-emitting section that emits detection light indicated by broken line in FIG. 1 and a light-receiving section that receives this detection light to detect the passing of the medium M in the discharge path T4. The medium passing detection sensor 22 may be a reflection-type photo sensor that detects the presence of the medium M by detecting the detection light, which is reflected by the medium M, by the light-receiving section. Alternatively, it may be a transmission-type photo sensor that detects the presence of the medium M when the detection light is reflected by the medium M and the light-receiving section cannot detect the detection light.

As shown in FIG. 2, the control section 92 has a central processing unit 92*a* (CPU) that functions as a calculation processing device that controls the operation of the intermediate transport device 20. The control section 92 controls the operation of the transport section 21, including the transport roller pairs 23, based on the detection result of the medium passing detection sensor 22, for example. The control section 92 is configured to operate in conjunction with the control section 91 of the printing device 10 and the control section 93 of the medium stacking device 30.

The storage section 92*b* has, for example, a read only memory (ROM), a random access memory (RAM), and the like, similar to the storage section 91*b*.

The interface section 92*c* transfers various types of information to and from the printing device 10 and the medium stacking device 30. The interface section 92*c* is an example of the information acquisition section.

Figure 12:
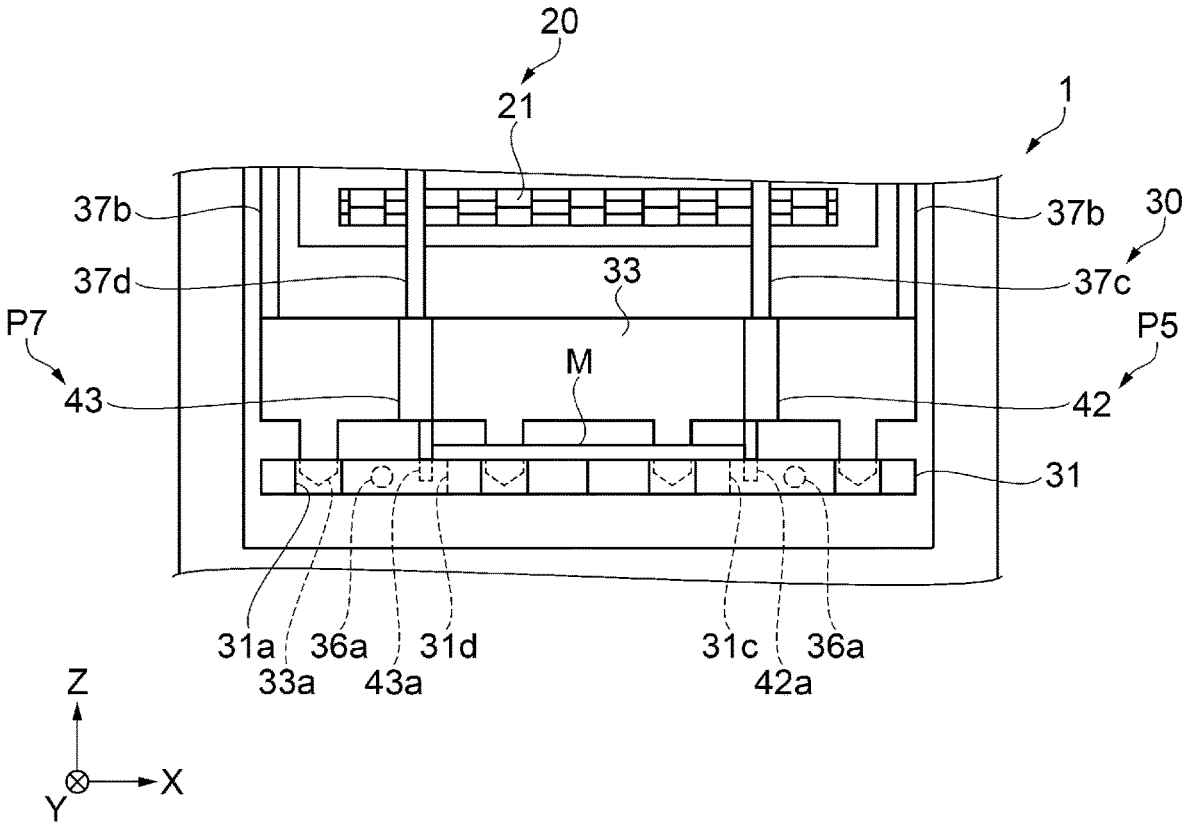
FIG. 12 is a schematic diagram for explaining the configuration of the medium stacking device.

As shown in FIG. 1, the medium stacking device 30 is equipped with a stacking platform 31, a first movable fence 32, a second movable fence 33, a top surface detection sensor 34, a placement defect detection sensor 35, the fan 39, and the control section 93. As shown in FIG. 12, the medium stacking device 30 may be equipped with a third movable fence 42 and a fourth movable fence 43. The first movable fence 32, the second movable fence 33, the third movable fence 42, and the fourth movable fence 43 are examples of the movable fence MF, which is provided in the medium stacking device 30. As shown in FIG. 2, the medium stacking device 30 is equipped with a storage section 93*b*, an interface section 93*c*, the stacking platform drive section 36, and the fence drive section 37.

Note that the medium stacking device 30 is located separately from the printing device 10, but may also be located as an integral unit with the printing device 10. Although the medium stacking device 30 is located in a printing system 1 with a single printing device 10, it may, for example, be located in a printing system 1 with multiple printing devices 10 arranged in series in the transport path of the medium M. Further, the medium stacking device 30 is located separately from the intermediate transport device 20, but it may be integrated with the intermediate transport device 20.

Further, the medium stacking device 30 does not have to stack the medium M that is ejected from the printing device 10. For example, a medium M that is discharged from a processing device that performs a process other than printing on a printed medium M may be stacked. If the intermediate transport device 20 is omitted, the medium M discharged from the printing device 10 may be directly stacked by the medium stacking device 30.

Figure 4:
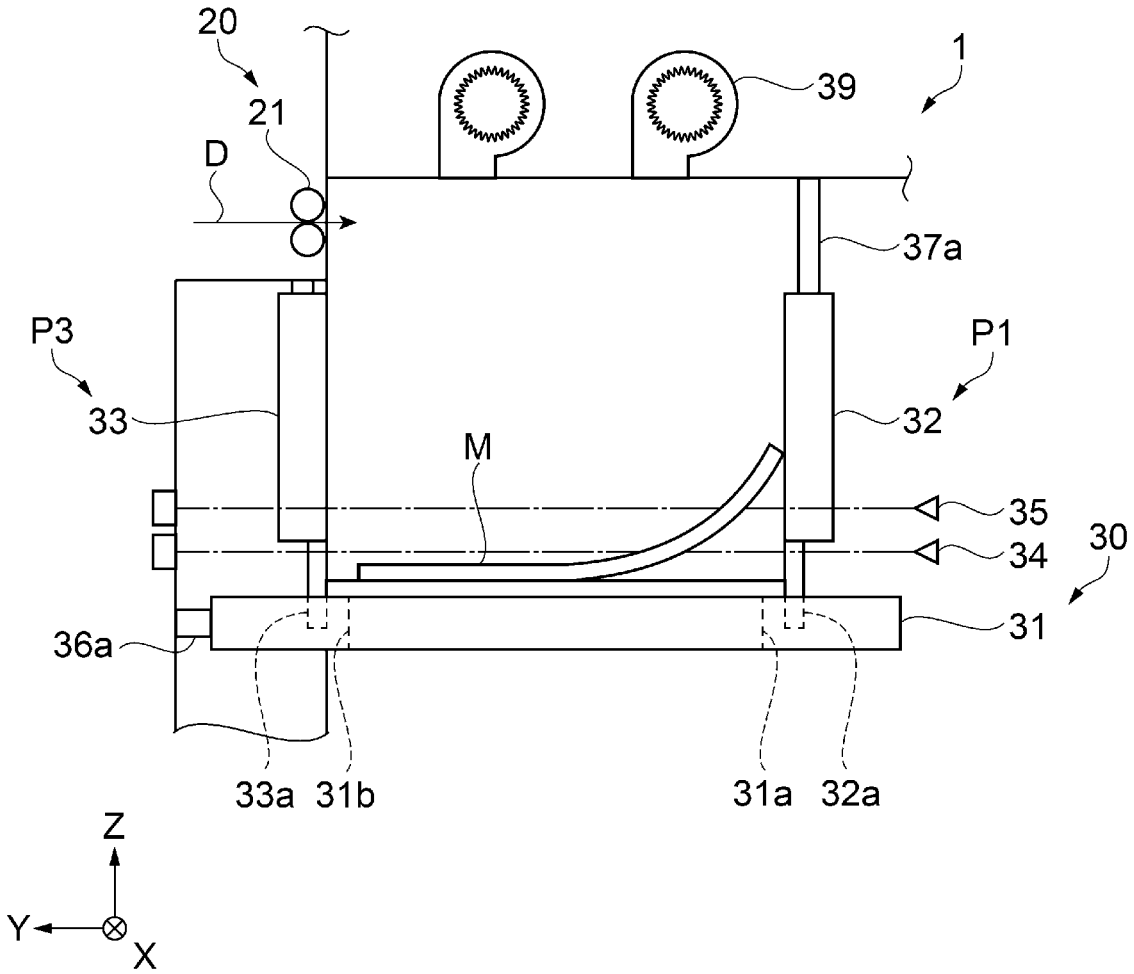
FIG. 4 is a schematic diagram for explaining the configuration of a medium stacking device and a placement defect resolution process.

As shown in FIG. 4, the medium M is stacked on the stacking platform 31. The stacking platform 31 is detachably located, for example, with respect to the stacking platform support section 36*a*, which is provided in the medium stacking device 30. The stacking platform support section 36*a* is configured to be raised and lowered in the Z-axis direction by drive of the stacking platform drive section 36, to be described later. By this, the stacking platform 31 can be raised and lowered in the Z-axis direction by the drive of the stacking platform drive section 36. When the medium M is picked up, the stacking platform 31 may be lowered and placed on the cart 100 (see FIG. 1) and removed from the medium stacking device 30 together with the medium M.

The first movable fence 32 is provided in the −Y direction side of the medium M, which is placed on the stacking platform 31. The first movable fence 32 has a protruding portion 32*a* that protrudes toward the −Z direction of the first movable fence 32. The protruding portion 32*a* can enter a slit 31*a* in the stacking platform 31. The slit 31*a* extends from an edge portion of the −Y direction of the stacking platform 31 toward the center of it.

The first movable fence 32 is held by a fence holding section 37*a*. The fence holding section 37*a* moves in the Y-axis direction by the fence drive section 37 being driven. By this, when the fence drive section 37 is driven, the first movable fence 32 moves in the Y-axis direction while the protruding portion 32*a* is in a state entered in the slit 31*a*.

The first movable fence 32 moves between a restriction position P1, which restricts the medium M discharged toward the stacking platform 31, and a retreat position P2 (see FIG. 5), which is retreated in the −Y direction from this restriction position P1. The first movable fence 32 is, for example, an end fence that restricts the position of the front edge of the medium M in the discharge direction D at the restriction position P1. The first movable fence 32 moves from the restriction position P1 to the retreat position P2 along the Y-axis direction. The discharge direction D is the same as the −Y direction. As the first movable fence 32 moves from the restriction position P1 to the retreat position P2 (see FIG. 5), leaning of the medium M against the first movable fence 32 (see FIG. 4) is resolved.

The second movable fence 33 is provided in the +Y direction side of the medium M that is placed on the stacking platform 31. The second movable fence 33 is provided at a position with respect to the Y-axis direction, where the medium M placed on the stacking platform 31 is sandwiched between the first movable fence 32 and the second movable fence 33. The second movable fence 33 has a protruding portion 33*a* that protrudes toward the −Z direction of the second movable fence 33. The protruding portion 33*a* can enter a slit 31*b* in the stacking platform 31. The slit 31*b* extends from an edge portion of the +Y direction side of the stacking platform 31 toward the center of it.

As shown in FIG. 12, the second movable fence 33 is held by a fence holding section 37*b*. The fence holding section 37*b* moves in the Y-axis direction when the fence drive section 37 is driven. By this, when the fence drive section 37 is driven, the second movable fence 33 moves in the Y-axis direction while the protruding portion 33*a* is in a state entered in the slit 31*b*.

As shown in FIG. 4, the second movable fence 33 moves between a restriction position P3, which restricts the medium M to be discharged toward the stacking platform 31, and a retreat position P4 (see FIG. 9), which is retreated in the +Y direction from this restriction position P3. The second movable fence 33 is, for example, a guide fence that restricts the position of the rear edge of the medium M in the discharge direction D at the restriction position P3. The second movable fence 33 moves along the Y-axis direction from the restriction position P3 to the retreat position P4. As the second movable fence 33 moves from the restriction position P3 to the retreat position P4 (see FIG. 9), leaning of the medium M against the second movable fence 33 (see FIG. 8) is resolved.

The first movable fence 32 and the second movable fence 33 are located movably along the Y-axis direction and can perform an offset operation to move a stacking position of the medium M on the stacking platform 31 to an upstream or downstream side in the discharge direction D at a predetermined timing, such as at a break in the print job. The offset operation is an example of a partition operation. However, the first movable fence 32 and the second movable fence 33 may be movable fences MF that are not used in an offset operation.

As shown in FIG. 12, the third movable fence 42 is provided in the +X direction side of the medium M placed on the stacking platform 31. The third movable fence 42 is provided at a position, with respect to the X-axis direction, where the medium M placed on the stacking platform 31 is sandwiched between the third movable fence 42 and the fourth movable fence 43. The third movable fence 42 has a protruding portion 42*a* that protrudes toward the −Z direction of the third movable fence 42. The protruding portion 42*a* can enter a slit 31*c* in the stacking platform 31. The slit 31*c* extends from an edge portion of the +X direction side of the stacking platform 31 toward the center of it.

The third movable fence 42 is held by a fence holding section 37*c*. The fence holding section 37*c* moves in the X-axis direction when the fence drive section 37 is driven. By this, when the fence drive section 37 is driven, the third movable fence 42 moves in the X-axis direction while the protruding portion 42*a* is in a state entered in the slit 31*c*.

The third movable fence 42 moves between a restriction position P5, which restricts the medium M to be discharged toward the stacking platform 31, and a retreat position P6 (not shown), which is retreated in the +X direction from this restriction position P5. The third movable fence 42 is, for example, a side fence that restricts the position of the side edge of the medium M in the +X direction at the restriction position P5. The third movable fence 42 moves along the X-axis direction: from the restriction position P5 to the retreat position P6. Note that the X-axis direction, which is orthogonal to the discharge direction D, is the width direction of the medium M. As the third movable fence 42 moves from the restriction position P5 to the retreat position P6, leaning of the medium M against the third movable fence 42 is resolved.

The fourth movable fence 43 is provided in the −X direction side of the medium M that is placed on the stacking platform 31. The fourth movable fence 43 has a protruding portion 43*a* that protrudes toward the −Z direction of the fourth movable fence 43. The protruding portion 43*a* can enter a slit 31*d* in the stacking platform 31. The slit 31*d* extends from an edge portion of the −X direction of the stacking platform 31 toward the center of it.

The fourth movable fence 43 is held by a fence holding section 37*d*. The fence holding section 37*d* moves in the X-axis direction when the fence drive section 37 is driven. By this, when the fence drive section 37 is driven, the fourth movable fence 43 moves in the X-axis direction while the protruding portion 43*a* is in a state entered in the slit 31*d*.

The fourth movable fence 43 moves between a restriction position P7, which restricts the medium M to be discharged toward the stacking platform 31, and a retreat position P8 (not shown), which is retreated in the −X direction from this restriction position P7. The fourth movable fence 43 is, for example, a side fence that restricts the position of the side edge of the medium M in the −X direction at the restriction position P7. The fourth movable fence 43 moves along the X-axis direction from the restriction position P7 to the retreat position P8. As the fourth movable fence 43 moves from the restriction position P7 to the retreat position P8, leaning of the medium M against the fourth movable fence 43 is resolved.

As shown in FIGS. 1 and 4, the top surface detection sensor 34 is a sensor for detecting the height of the stacking surface of the stacking platform 31, that is, the height of the topmost sheet of the medium M. When no medium M is stacked, the top surface detection sensor 34 detects the height of an upper surface of the stacking platform 31. The top surface detection sensor 34 is, for example, a transmission-type photo sensor having a light-emitting section that emits detection light and a light-receiving section that receives the detection light. The light-emitting section emits the detection light, which is shown in FIGS. 1 and 4 in single dotted line, horizontally at a height that is the desired stacking surface without interfering the first movable fence 32 and the second movable fence 33. The light-receiving section receives this detection light.

For example, it is assumed that the detection light emitted from the light-emitting section of the top surface detection sensor 34 is blocked by the medium M and the light-receiving section of the top surface detection sensor 34 cannot receive the detection light. In this case, the control section 93 (to be described later) controls the stacking platform drive section 36 to lower the stacking platform 31 to a position where the detection light is no longer blocked by the medium M. The position where the detection light is no longer blocked by the medium M is, for example, the position where the medium M is below the detection light by the thickness of several sheets of the medium.

Note that the control section 93 can detect the height of the medium stacking surface, for example, based on the number of sheets of the medium M, which pass through the intermediate transport device 20 and are detected by the medium passing detection sensor 22 of the intermediate transport device 20, and the thickness of a sheet of the medium M. Alternatively, the control section 93 can detect the height of the medium stacking surface based on the discharge interval of the medium M obtained from the printing device 10, and on the thickness of a sheet of the medium M. Alternatively, the control section 93 can detect the height of the medium stacking surface based on a detection result of a weight detection sensor (not shown) of the stacking platform 31. When the height of the stacking surface is detected in these ways, the top surface detection sensor 34 may not be needed.

The placement defect detection sensor 35 is a sensor that detects a defect in the placement state of a medium M placed on the stacking platform 31 or a medium M placed on the medium M on the stacking platform 31. The defect in the placement state of the medium M includes, for example, leaning of the medium M against the movable fence MF, deformation of the medium M due to curling, and the like.

The placement defect detection sensor 35 is, for example, a transmission-type photo sensor with a light-emitting section that emits detection light horizontally and a light-receiving section that receives this detection light, as shown in FIGS. 1 and 4 in single dotted line. The light-emitting section of the placement defect detection sensor 35 horizontally emits detection light, which is shown in single dotted line in FIGS. 1 and 4, without interfering with the first movable fence 32 and the second movable fence 33. The detection light from the light-emitting section of the placement defect detection sensor 35 is emitted to a region above the detection light that is emitted by the light-emitting section of the top surface detection sensor 34. For example, it is assumed that the detection light emitted from the light-emitting section of the placement defect detection sensor 35 is blocked by the medium M, and that a state in which the light-receiving section of the placement defect detection sensor 35 is unable to receive the detection light continues for higher than the specified time period. In this case, the control section 93 (to be described later) determines that there is a defect in the placement state of the medium M. Note that the first movable fence 32 and the second movable fence 33 may have a through hole so that the detection light from the light-emitting section of the placement defect detection sensor 35 does not interfere with the movable fence. Alternatively, at least a portion of the first movable fence 32 and the second movable fence 33 through which the detection light from the light-emitting section of the placement defect detection sensor 35 passes, may be formed of a material through which the detection light passes, for example, a transparent member.

Note that the control section 93 may determine that there is the placement defect of the medium M if the lowering amount of the stacking platform 31 is larger than the lowering amount of the stacking platform 31, which corresponds to a number of passed sheets of the medium obtained from the history in a certain period in the past. When determining the presence or absence of the placement defect of the medium M in this manner, the placement defect detection sensor 35 may be omitted.

As shown in FIGS. 1 and 4, the fan 39 is provided in the +Z direction side of the medium stacking device 30, which is above the stacking platform 31. A plurality of fans 39 may be provided. In this embodiment, for example, three pairs of fans 39 are arranged spaced apart in the X-axis direction. The fans of each pair of fans 39 are located spaced apart in the Y-axis direction. The fan 39 may have a shutter that opens and closes a blower opening. When the fan 39 is driven, the shutter opens to blow air from the blower opening toward the stacking platform 31, which is in the −Z direction side. When drive of the fan 39 is stopped, the shutter closes to stop air blowing from the blower opening. Further, the fan 39 can adjust the wind power of the air being blown. The fan 39 can accelerate drying of the medium M by blowing warm air.

The stacking platform drive section 36 is an actuator, such as a motor, which raises and lowers the stacking platform 31.

The fence drive section 37 is an actuator, such as a motor, that moves the movable fence MF between the restriction positions P1, P3, P5, P7 and the retreat positions P2, P4, P6, P8.

As shown in FIG. 2, the control section 93 has a central processing unit (CPU) 93*a* that functions as a calculation processing unit that controls the operation of the entire medium stacking device 30. As described above, the control section 93 determines, for example, whether or not there is a defect in the placement state of the medium M based on the detection light received by the light-receiving section of the placement defect detection sensor 35. If the control section 93 determines that there is a defect in the placement state of the medium M, the control section 37 performs a control to move the movable fence MF from the restriction position to the retreat position and then back to the restriction position, by using the fence drive section 37. The control section 93 is configured to operate in conjunction with the control section 91 of the printing device 10 and the control section 92 of the intermediate transport device 20.

The storage section 93*b* has, for example, a read only memory (ROM), a random access memory (RAM), and the like, similarly to the storage section 91*b*.

The interface section 93*c* transfers various types of information to and from the printing device 10 and the intermediate transport device 20. The interface section 93*c* is an example of the information acquisition section. For example, the interface section 93*c* obtains the detection result of the medium passing detection sensor 22 from the control section 92. For example, the interface section 93*c* obtains from the control section 91 the printing information about the image to be printed on the medium M and the medium information about the medium M on which the image is to be printed.

Next, referring to the flowchart shown in FIG. 3, each step of the control performed by the control section 93 when the medium M is placed on the stacking platform 31 of the medium stacking device 30 will be described in order. In this embodiment, the process flow executed by the control section 93 when the medium M is placed on the stacking platform 31 corresponds to the control method of the medium stacking device 30. Note that when the control section 91 of the printing device 10 controls the entire printing system 1 in conjunction with the control section 92 and the control section 93, the sequence of processes executed by the control section 93 below correspond to the control method of the printing system 1.

Figure 3:
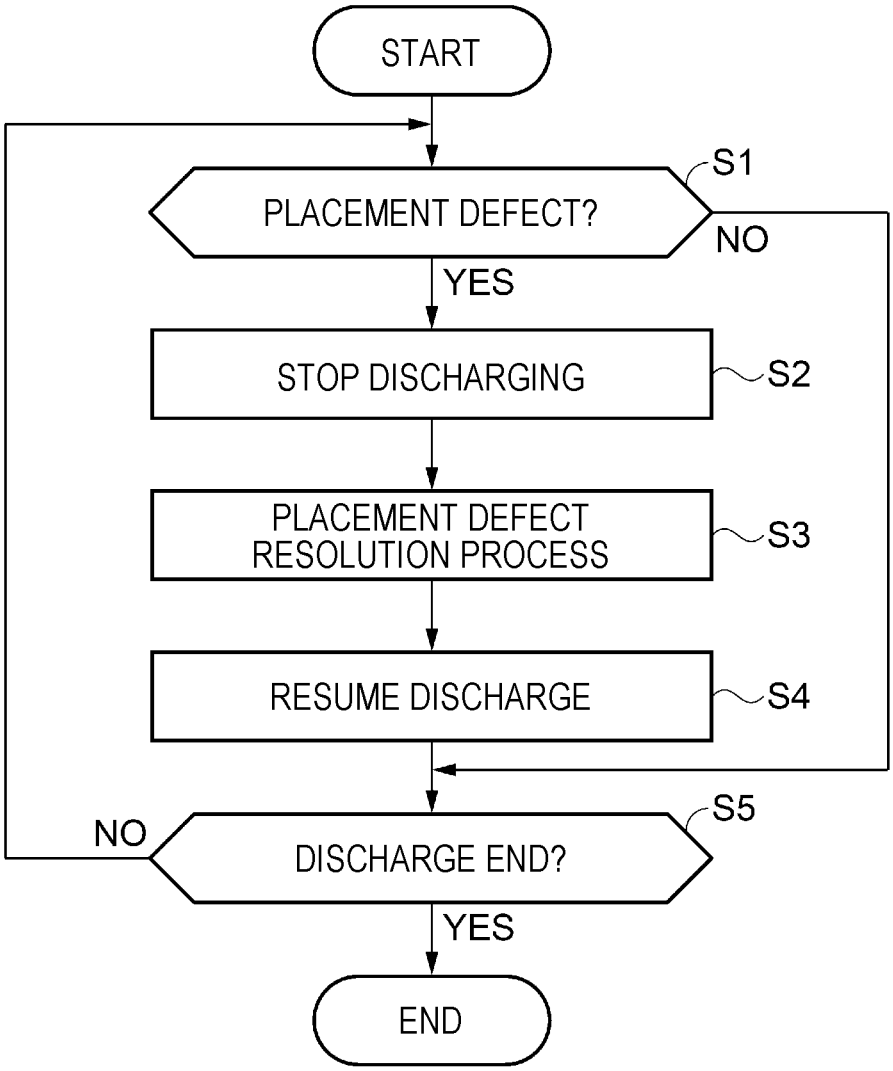
FIG. 3 is a flowchart showing a process when a medium is placed on the stacking platform.

Each of the processes in the flowchart shown in FIG. 3 is executed by the control section 93 of the medium stacking device 30, for example, when the operation of discharging the medium M to the medium stacking device 30 starts. Note that at least before performing a placement defect resolution process (to be described later), the control section 93 obtains the medium information of the discharged medium M and the printing information of the image to be printed on the medium M via the interface section 93*c*.

First, in step S1, the control section 93 confirms whether there is a placement defect of the medium M placed on the stacking platform 31. Specifically, the control section 93 confirms whether a state, in which the detection light emitted from the light-emitting section of the placement defect detection sensor 35 is blocked by the medium M and the light-receiving section cannot receive the detection light, is continuing for more than specified time period.

Note that the control section 93 may change the above specified time period based on at least one type of the medium information of the medium M to be discharged toward the stacking platform 31 and at least one type of the printing information of the image printed on the medium M. By this, the timing for detecting a placement defect of the medium M on the stacking platform 31 can be adjusted. In this case, the control section 93 obtains the above-mentioned medium information of the medium M and the printing information of the image to be printed on the medium M before detecting a placement defect of the medium M on the stacking platform 31.

The detection timing to be adjusted based on the medium information and printing information is confirmed by experimentation in advance and is then set as a set value and stored in storage section 93*b* or storage section 91*b*. For example, the detection timing is set to be later for a medium M with a relatively high friction coefficient than for a medium with a relatively low friction coefficient.

In step S1, if the time period that the light-receiving section of the placement defect detection sensor 35 cannot receive any detection light is shorter than the specified time period, the control section 93 determines that there is no placement defect of the medium M on the stacking platform 31. In this case, step S1 becomes NO, and the control section 93 advances the process to step S5. If the state in which the light-receiving section of the placement defect detection sensor 35 cannot receive the detection light continues for longer than the specified time period, the control section 93 determines that there is the placement defect (see FIG. 4) of the medium M on the stacking platform 31, and step S1 becomes YES. In this case, the control section 93 advances the process to step S2.

In step S2, the control section 93 stops discharging the medium M to the stacking platform 31. Specifically, the control section 93 sends an instruction to the control section 91 of the printing device 10 to stop printing, and sends an instruction to the control section 92 of the intermediate transport device 20 to stop transporting the medium M. After executing step S2, the control section 93 advances the process to step S3.

In step S3, the control section 93 executes the placement defect resolution process. First, the control section 93 determines the movement amount MA from the restriction position P1 to the retreat position P2 based on the medium information of the medium M and the printing information of the image printed on the medium M. By determining the movement amount MA, a position of the retreat position P2 is determined.

The movement amount MA from the restriction position P1 to the retreat position P2 that was determined based on the medium information and the printing information is set as the optimum set value dn and is stored in the storage section 93*b* or storage section 91*b*. The set value dn is, for example, a value confirmed in advance by experiments. For example, if the friction coefficient of the medium M is high, the frictional force between the medium M and the movable fence MF will become high. Also, if the friction coefficient of the medium M is high, the friction force between the medium M and the medium M placed on the stacking platform 31, or between the medium M and the stacking surface of the stacking platform 31 becomes high. Therefore, leaning of the medium M on the movable fence MF is less likely to be resolved when the medium M has a relatively high friction coefficient than when the medium M has a relatively low friction coefficient.

The medium M printed with an image having a relatively high print duty as calculated from the print data has more ink applied to it than the medium M printed with an image having a relatively low print duty. Therefore, the medium M printed with an image having a relatively high print duty is wetter and less likely to slide than the medium M printed with an image having a relatively low print duty.

In this embodiment, the movement amount MA from the restriction position P1 to the retreat position P2 is set, for example, considering the paper type of the medium M and the print duty, which is calculated from the print data of the image to be printed on the medium M. For example, it will be assumed that there are three different paper types A, B, and C. It will be assumed that with respect to the friction coefficients of paper types A, B, and C, paper type A has the lowest friction coefficient and paper type C has the highest friction coefficient. In this case, in the present embodiment, set values d1, d2, d3, d4, d5, and d6, which set the movement amount MA, are stored in the storage section 93*b* or the storage section 91*b*, as shown in a set value table in FIG. 18.

When the print duty is less than 40%, the set values d1, d2, and d3 are set for paper types A, B, and C, respectively, as the movement amount MA, wherein the set value d1 is the smallest and the set value d3 is the largest among them. In other words, the movement amount MA is set to a larger value for a medium M with a relatively high friction coefficient than for a medium M with a relatively low friction coefficient.

The set value d4 set for the movement amount MA that corresponds to paper type A when the print duty is higher than 40%, is greater than the set value d1 set for the movement amount MA that corresponds to paper type A when the print duty is lower than 40%. The set value d5 set for the movement amount MA that corresponds to paper type B when the print duty is higher than 40%, is greater than the set value d2 set for the movement amount MA that corresponds to paper type B when the print duty is less than 40%. The set value d6 set for the movement amount MA that corresponds to paper type C when the print duty is higher than 40%, is greater than the set value d3 set for the movement amount MA that corresponds to paper type C when the print duty is less than 40%.

In other words, the movement amount MA is set to a larger value for a medium M with relatively high print duty than for a medium M with relatively low print duty. Note that, for example, if experimental results show that the sliding property of paper type A tends to decrease significantly when the print duty is higher than 40%, the set value d4 may be larger than the set value d3.

Further, even if the friction coefficient of medium M is the same, as the basis weight increases, the friction force between the medium M and the medium M placed on the stacking platform 31 or between the medium M and the stacking surface of the stacking platform 31 increases. Therefore, leaning against the movable fence MF of a medium M with a relatively high basis weight is less likely to be resolved than for a medium M with a relatively low basis weight. Therefore, in this embodiment, the movement amount MA is set to a larger value for a medium M with relatively large basis weight than for a medium M with relatively small basis weight, even if the friction coefficient is the same.

In this case, the movement amount MA may also be set by considering the basis weight of the medium M and the print duty calculated from the print data of the image to be printed on the medium M. In this case, a set value dn corresponding to a combination of the basis weight of the medium M and the print duty of the image to be printed may be stored in the storage section 93*b* or the storage section 91*b*.

Further, for example, if the transport speed of the medium M on which the image is printed is relatively fast, the solvent component of the ink, that is, moisture, evaporates less from the medium M than if the transport speed of the medium M is relatively slow. Therefore, even if the print duty is the same, the movement amount MA may be set to a larger value when the transport speed of medium M is relatively fast than when the transport speed of medium M is relatively slow.

In this case, the movement amount MA may also be set by considering the transport speed of the medium M on which the image is printed and the print duty calculated from the print data of the image to be printed on the medium M. In this case, the set value dn corresponding to a combination of the transport speed of the medium M and the print duty of the image to be printed may be stored in the storage section 93*b* or the storage section 91*b*.

Further, if the discharge speed of the medium M on which the image is printed is relatively fast, the landing position of the medium M is more likely to be biased toward the −Y direction side than if the discharge speed of the medium M is relatively slow. As a result, the medium tends to lean more against the first movable fence 32 when the medium M is discharged at a relatively fast speed than when the medium M is discharged at a relatively slow speed. Therefore, the movement amount MA may be set a larger value when the discharge speed of the medium M is relatively fast than when the discharge speed of the medium M is relatively slow.

On the other hand, even if the weight of the medium M is the same before printing, the weight of the medium M after printing will change if the amount of ink applied to the medium M by printing differs. That is, if the print duty calculated from the print data of the image to be printed on the medium M is different, the weight of the medium M after printing will change. If the weight of the medium M differs, the landing position of the medium M discharged toward the stacking platform 31 may be uneven. Therefore, the movement amount MA may be set by considering the discharge speed of the medium M on which the image is printed and the print duty calculated from the print data of the image to be printed on the medium M. In this case, the set value dn corresponding to the combination of the discharge speed of the medium M and the print duty of the image to be printed may be stored in the storage section 93*b* or the storage section 91*b*.

Furthermore, the movement amount MA may be set by considering three or more types of information among the medium information of the medium M and the printing information of the image to be printed on the medium M. For example, the movement amount MA may be set by considering the paper type of the medium M, the print duty calculated from the print data of the image to be printed on the medium M, and whether double-sided printing is selected or not. For example, the movement amount MA may be set by considering the paper type of the medium M, the discharge interval of the medium M, the print quality of the image to be printed on the medium M, and whether a double-sided printing is selected or not. In these cases, the setting value dn corresponding to the combination of three or more types of information described above may be stored in the storage section 93*b* or the storage section 91*b*.

In this way, the control section 93 determines the movement amount MA from the restriction position P1 to the retreat position P2 based on at least one type of medium information of the medium M and at least one type of printing information of the image printed on the medium M. By determining the movement amount MA, a position of the retreat position P2 is determined.

Figure 5:
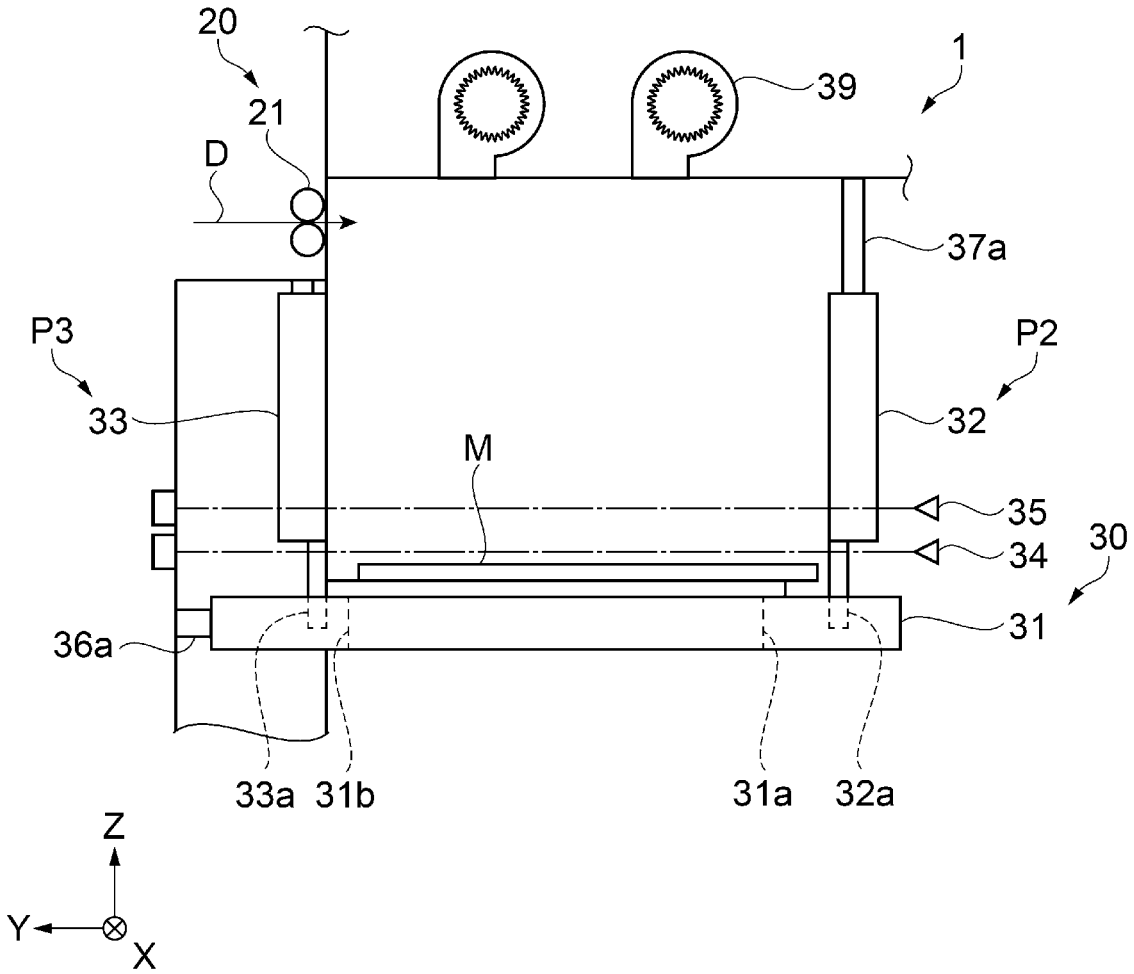
FIG. 5 is a schematic diagram for explaining the placement defect resolution process.

Next, the control section 93 controls the fence drive section 37 to move the first movable fence 32 from the restriction position P1 shown in FIG. 4 to the retreat position P2 shown in FIG. 5. By this, for example, as shown in FIG. 5, leaning of the medium M against the first movable fence 32 (see FIG. 4), which occurred at the restriction position P1, is resolved.

Figure 6:
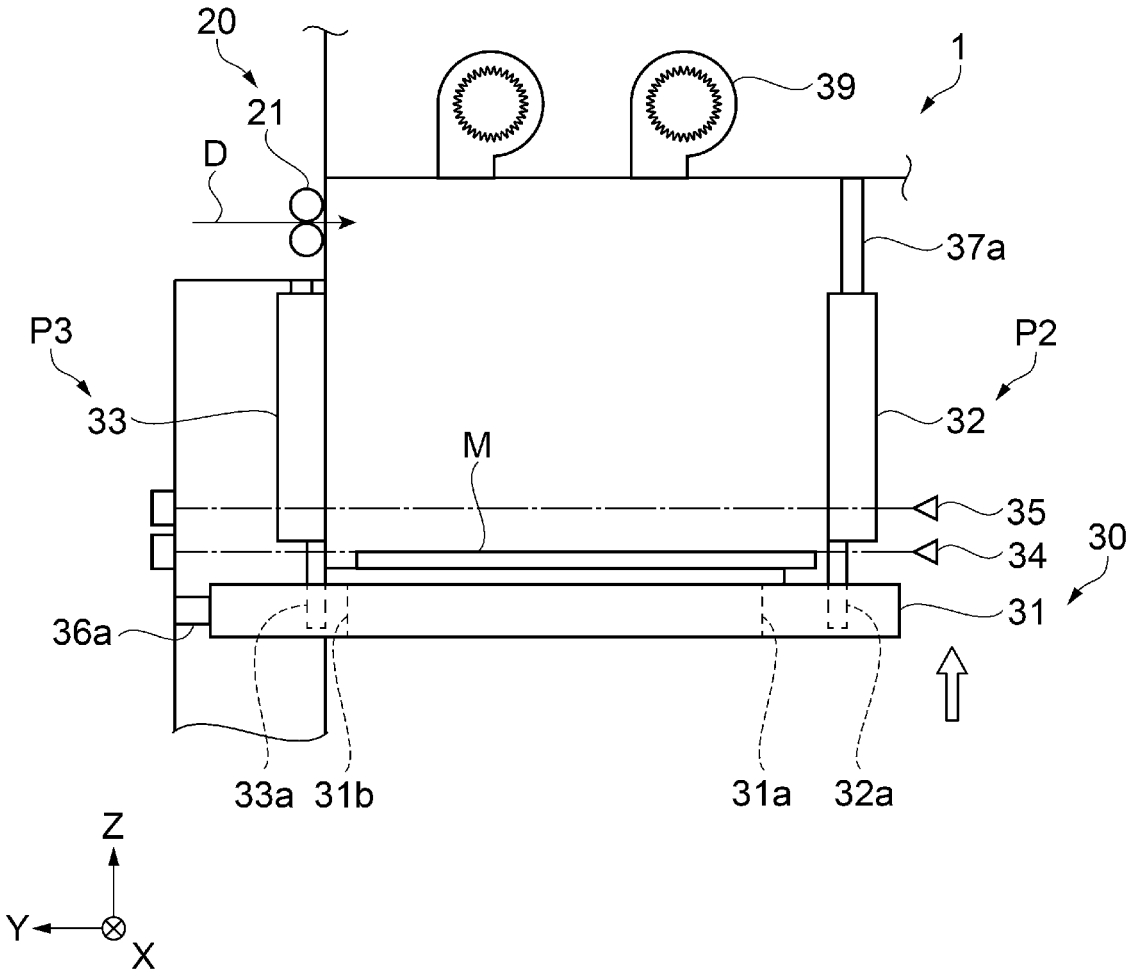
FIG. 6 is another schematic diagram for explaining the placement defect resolution process.

Next, as shown in FIG. 6, the control section 93 controls the stacking platform drive section 36 to move the stacking platform 31 in the +Z direction, as indicated by the white arrow. The control section 93 raises the stacking platform 31 to a position where a position of the detection light from the top surface detection sensor 34 and a position of the top surface of the stacked medium M become the same in the Z-axis direction. In this case, the control section 93 may move the stacking platform 31 in the +Z direction until the top surface detection sensor 34 detects the stacking surface of the stacking platform 31, and then lower the stacking platform 31 in the −Z direction until the top surface detection sensor 34 no longer detects the top surface of the medium M.

Figure 7:
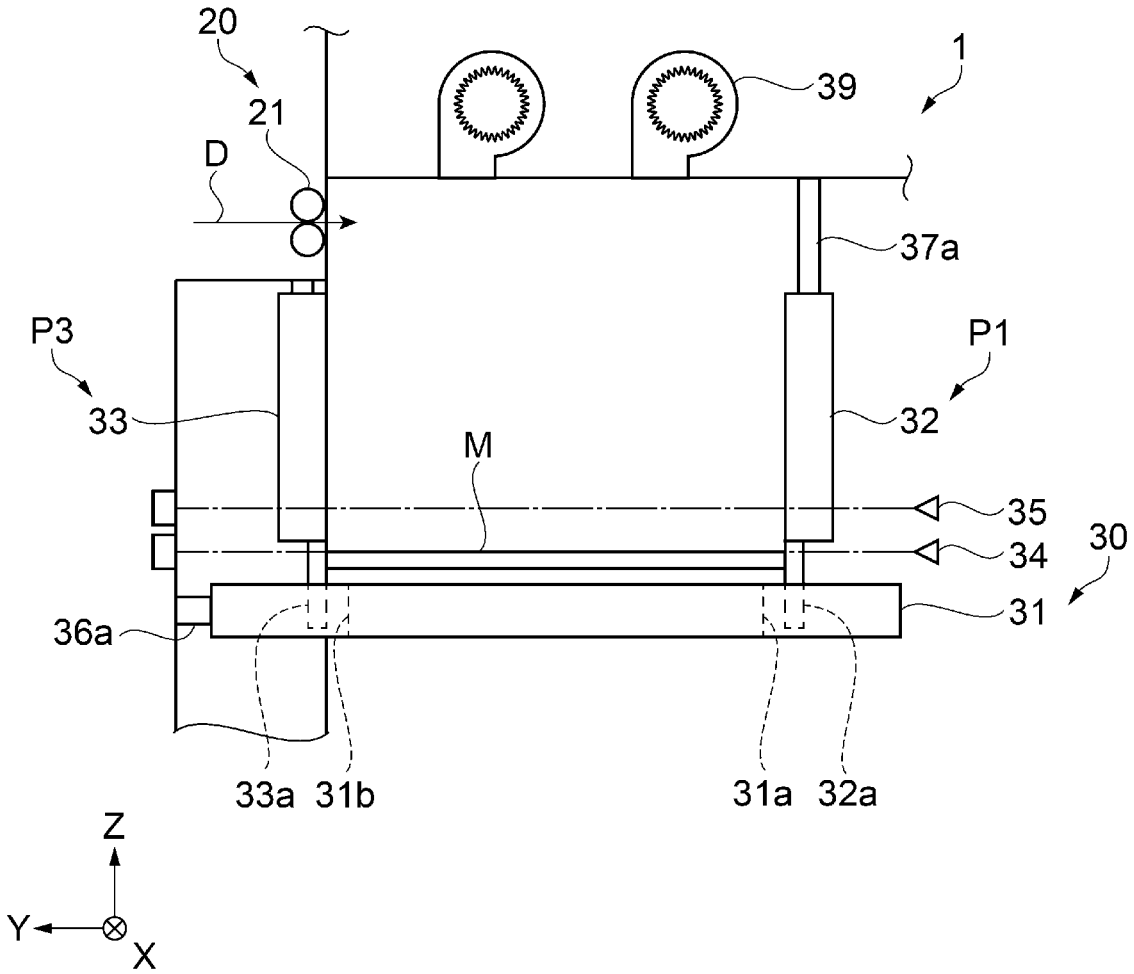
FIG. 7 is still another schematic diagram for explaining the placement defect resolution process.

Next, as shown in FIG. 7, the control section 93 controls the fence drive section 37 to move the first movable fence 32 from the retreat position P2 to the restriction position P1. By this, the medium M, which is no longer leaning against the first movable fence 32, is moved to the stacking position by the first movable fence 32.

As described above, the control section 93 performs a control to raise the stacking platform 31 between the control to move the first movable fence 32 from the restriction position P1 to the retreat position P2 and a control to return the first movable fence 32 to the restriction position P1. However, the control section 93 does not have to lower the stacking platform 31 if, for example, the detection light from the light-emitting section of the placement defect detection sensor 35 is blocked by the medium M and the light-receiving section cannot receive the detection light. By this, the control to raise the stacking platform 31 shown in FIG. 6 can be omitted. After executing step S3, the control section 93 advances the process to step S4.

In step S4, the control section 93 resumes discharging the medium M to the stacking platform 31. Specifically, the control section 93 sends an instruction to the control section 91 of the printing device 10 to resume printing and sends an instruction to the control section 92 of the intermediate transport device 20 to resume transporting the medium M. After executing step S4, the control section 93 advances the process to step S5.

In step S5, the control section 93 confirms whether or not the discharge of the medium M toward the stacking platform 31 is complete. Specifically, the control section 93 confirms with the control section 91 of the printing device 10 or the control section 92 of the intermediate transport device 20 whether or not the process of the print job is completed, thereby confirming whether or not the discharge of the medium M is completed. In step S5, if the discharge of the medium M is completed, step S5 becomes YES, and control section 93 ends the process. In step S5, if the discharge of the medium M is not completed, step S5 becomes NO. In this case, the control section 93 advances the process to step S1 and again confirms whether or not there is a placement defect of the medium M on the stacking platform 31.

Note that the control section 93 may perform the aforementioned offset operation by moving the first movable fence 32 and the second movable fence 33 in the Y-axis direction at a predetermined timing, such as after completing the discharge of the medium M or at a break of the print job during the discharge.

As described above, according to the medium stacking device 30, the printing system 1, and the control method of the medium stacking device 30 in the first embodiment, the following effects can be obtained.

The medium stacking device 30 is equipped with the stacking platform 31 on which the medium M, on which the image has been printed by ejecting ink, can be stacked. The medium stacking device 30 is equipped with the movable fence MF that moves between the restriction position, which restricts the edge portion of the medium M to be discharged toward the stacking platform 31, and the retreat position, which is retreated from the restriction position. The medium stacking device 30 is equipped with the control section 93 that performs control of moving the movable fence MF from the restriction position to the retreat position and back to the restriction position, when a placement defect of medium M on the stacking platform 31 is detected. The control section 93 determines the movement amount MA from the restriction position to the retreat position based on the medium information of the medium M and the printing information of the image.

By this, the movement amount MA and retreat position of the movable fence MF can be set, by considering changes in characteristics due to printing, such as change in the friction coefficient of the medium M and deformation of the medium M. As a result, the frequency that the placement defect of the medium M on the stacking platform 31 cannot be resolved can be reduced compared to the case in which the movement amount MA of the movable fence MF is adjusted based on the medium information of the medium M. Therefore, it is possible to suppress stacking disorder of the medium M discharged on the stacking platform 31, while suppressing a drop in the discharge efficiency of medium M.

The medium information is at least one of paper type, size, basis weight, paper quality, discharge speed, and discharge interval of the medium M. According to this, the movement amount MA of the movable fence MF from the restriction position to the retreat position can be determined based on at least one of the paper type, size, basis weight, paper quality, discharge speed, and discharge interval of the medium M and printing information of the image. Therefore, it is possible to suppress stacking disorder of the medium M discharged on the stacking platform 31, while suppressing a drop in the discharge efficiency of medium M.

The medium information is the paper type, and the printing information is the print duty when the image is printed on medium M. According to this, the movement amount MA of the movable fence MF from the restriction position to the retreat position can be determined based on the paper type of the medium M and the printing duty when the image is printed on the medium M. Therefore, it is possible to suppress stacking disorder of the medium M discharged on the stacking platform 31, while suppressing a drop in the discharge efficiency of medium M.

The movable fence MF includes the first movable fence 32 and the second movable fence 33. The second movable fence 33 is provided at the position in the discharge direction D, in which the medium M is discharged, so that the medium M is sandwiched between the second movable fence 33 and the first movable fence 32. By this, it is possible to resolve placement defects caused by the medium M leaning against the movable fence MF, including the first movable fence 32 and the second movable fence 33. Therefore, it is possible to suppress stacking disorder of the medium M discharged on the stacking platform 31, while suppressing a drop in the discharge efficiency of medium M.

The movable fence MF includes the third movable fence 42 and the fourth movable fence 43. The third movable fence 42 is provided at a position in the direction that intersects the discharge direction D so that the medium M is sandwiched between the third movable fence 42 and the fourth movable fence 43. By this, it is possible to resolve placement defects caused by the medium M leaning against the movable fence MF, including the third movable fence 42 and the fourth movable fence 43. Therefore, it is possible to suppress stacking disorder of the medium M discharged on the stacking platform 31, while suppressing a drop in the discharge efficiency of medium M.

The stacking platform 31 can be raised and lowered. By this, the flexibility of stacking the medium M on the stacking platform 31 can be improved.

The control section 93 adjusts the detection timing of placement defects of the medium M based on the medium information and the printing information. By this, the time required to detect a placement defect of the medium M can be optimized. Therefore, it is possible to suppress stacking disorder of the medium M discharged on the stacking platform 31, while suppressing a drop in the discharge efficiency of medium M.

The printing system 1 is equipped with the above-mentioned medium stacking device 30 on which the medium M, on which an image is printed, is placed, and the printing device 10, which prints an image by ejecting ink onto the medium M. By this, it is possible to realize a printing system 1 that can suppress the occurrence of stacking disorder of medium M on the stacking platform 31, while suppressing the drop in efficiency of discharging medium M.

A control method for the medium stacking device 30 is the control method for a medium stacking device with the stacking platform 31 and the movable fence MF. The stacking platform 31 is capable of stacking the medium M on which the image has been printed by ejecting ink. The movable fence MF moves between the restriction position that restricts the edge portion of the medium M being discharged toward the stacking platform 31 and the retreat position retreated from the restriction position. The control method of the medium stacking device 30 includes confirming whether placement defects of the medium M on the stacking platform 31 are present on the stacking platform 31. The control method of the medium stacking device 30 also includes determining, when the placement defect of the medium M is detected, the movement amount MA from the restriction position to the retreat position based on the medium information of the medium M and the printing information of the image. Further, the control method of the medium stacking device 30 includes moving the movable fence MF from the restriction position to the retreat position based on the determined movement amount MA, and returning the movable fence FM to the restriction position.

By this, the movement amount MA and retreat position of the movable fence MF can be set, by considering changes in characteristics due to printing, such as change in the friction coefficient of the medium M and deformation of the medium M. As a result, the frequency that the placement defect of the medium M on the stacking platform 31 cannot be resolved can be reduced compared to the case in which the movement amount MA of the movable fence MF is adjusted based on the medium information of the medium M. Therefore, it is possible to suppress stacking disorder of the medium M discharged on the stacking platform 31, while suppressing a drop in the discharge efficiency of medium M.

2. Second Embodiment

The medium stacking device 30 and printing system 1 in a second embodiment differ from the medium stacking device 30 and printing system 1 in the first embodiment in the placement defect resolution process, which is performed in step S3 of the flowchart in FIG. 3. The configuration of the medium stacking device 30 and the printing system 1 for the second embodiment are the same as that of the medium stacking device 30 and the printing system 1 for the first embodiment.

Next, the placement defect resolution process, which is performed by the medium stacking device 30 and the printing system 1 in this embodiment in step S3 of the flowchart in FIG. 3, is described. In this embodiment, the sequence of processes in the placement defect resolution process executed by the control section 93 when the medium M is placed on the stacking platform 31, corresponds to the control method of the medium stacking device 30. Note that when the control section 91 of the printing device 10 controls the entire printing system 1 in conjunction with the control section 92 and the control section 93, the sequence of processes executed by the control section 93 below correspond to the control method of the printing system 1.

In this embodiment, as in the first embodiment, if it is determined in step S1 that there is a placement defect of the medium M on the stacking platform 31, the control section 93 executes the placement defect resolution process.

Figure 8:
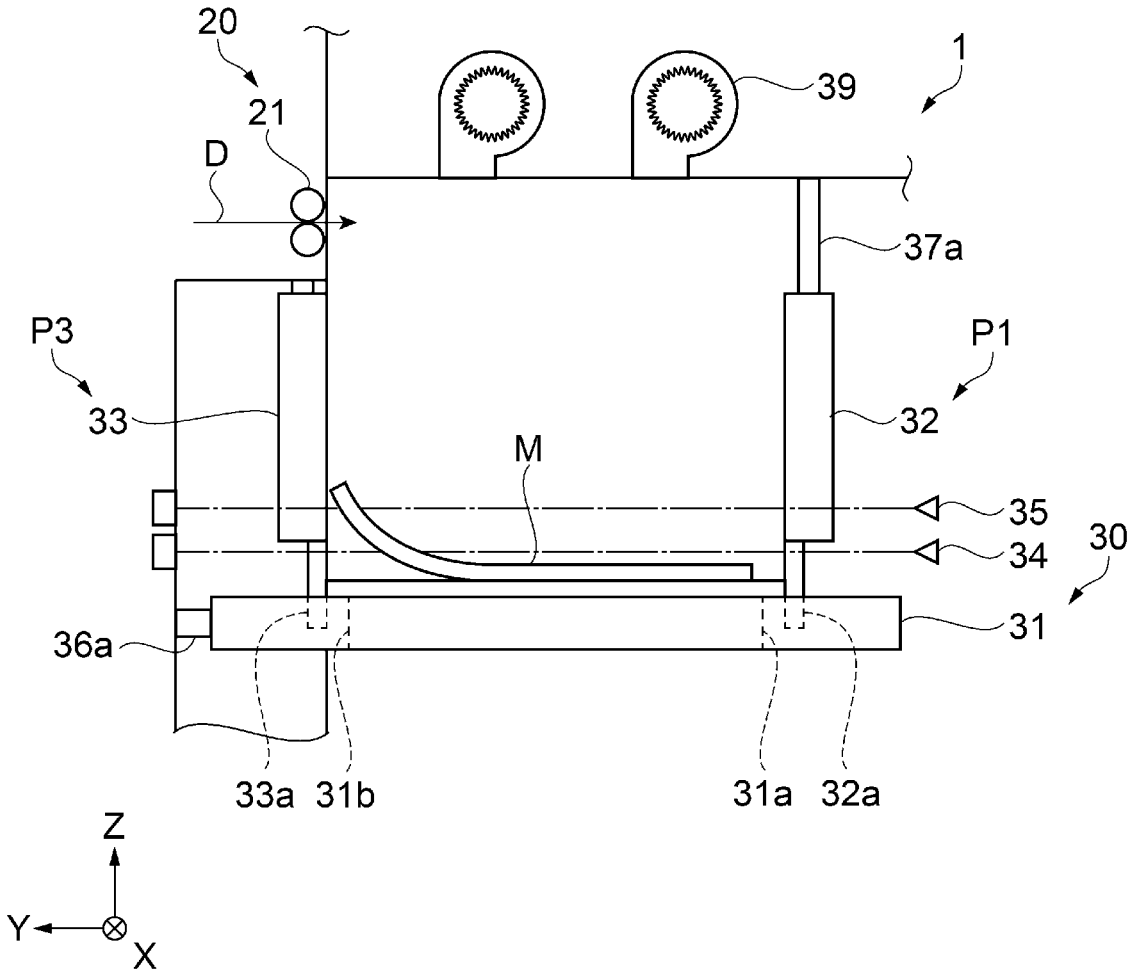
FIG. 8 is a schematic diagram for explaining the placement defect resolution process in a second embodiment.

Depending on the combination of the paper type of medium M and the print specifications of the image to be printed on the medium M, for example, the medium M discharged toward the stacking platform 31 may lean against the second movable fence 33 as shown in FIG. 8. In this embodiment, the placement defect resolution process moves the first movable fence 32, the second movable fence 33, the third movable fence 42, and the fourth movable fence 43 from the restriction position to the retreat position.

In this embodiment of the placement defect resolution process, first, the control section 93 also determines the movement amount MA of the movable fence MF from the restriction position to the retreat position based on the medium information of the medium M and the printing information of the image printed on the medium M. Once the movement amount MA is determined, the retreat position of the movable fence MF is determined.

Figure 9:
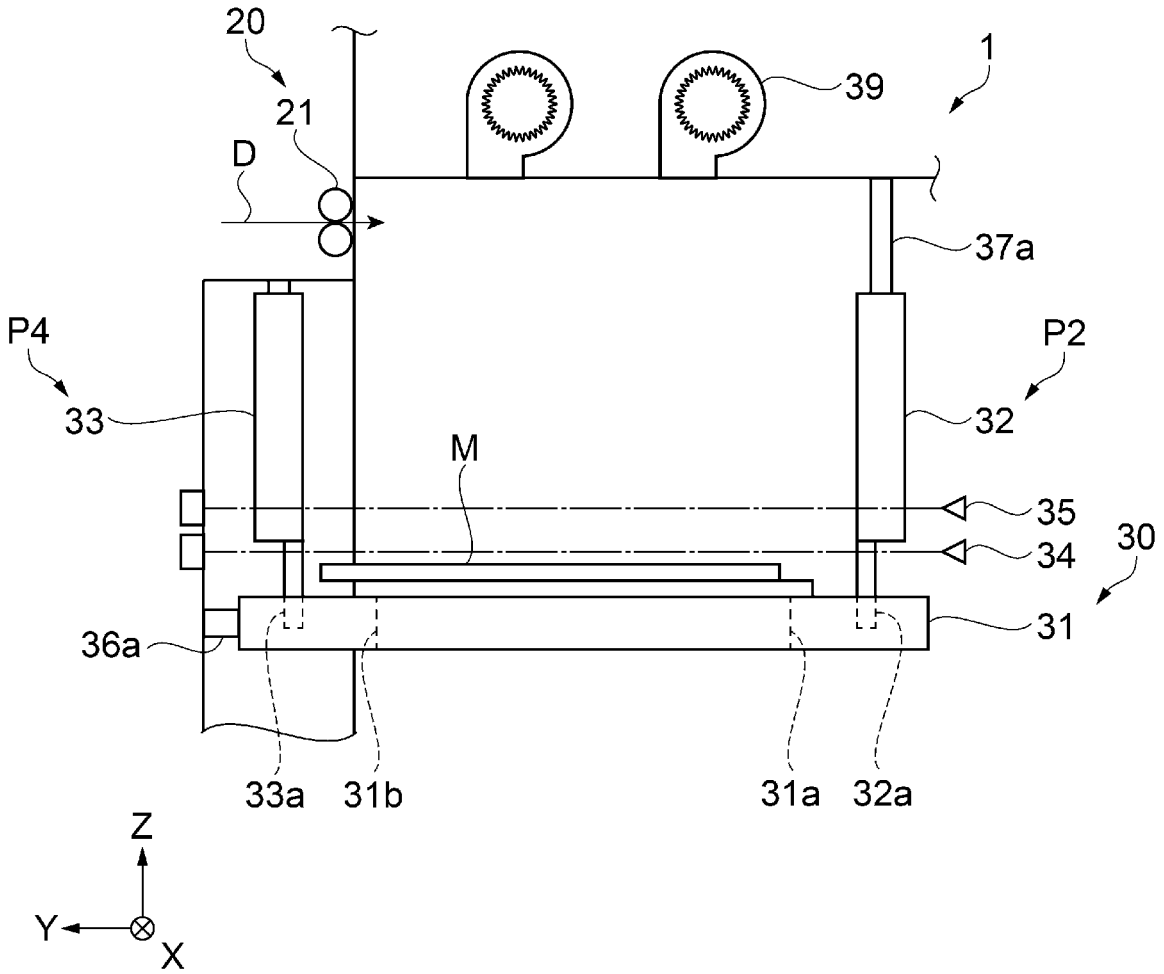
FIG. 9 is another schematic diagram for explaining the placement defect resolution process in the second embodiment.

Next, the control section 93 controls the fence drive section 37 to move the first movable fence 32 and the second movable fence 33 from the restriction positions P1 and P3 shown in FIG. 8 to the retreat positions P2 and P4. Further, the control section 93 controls the fence drive section 37 to move the third movable fence 42 and the fourth movable fence 43 (not shown) from the restriction positions P5 and P7 to the retreat positions P6 and P8. By this, for example, as shown in FIG. 9, leaning of the medium M against the second movable fence 33 (see FIG. 8), which has occurred at the restriction position P3, is resolved.

Figure 10:
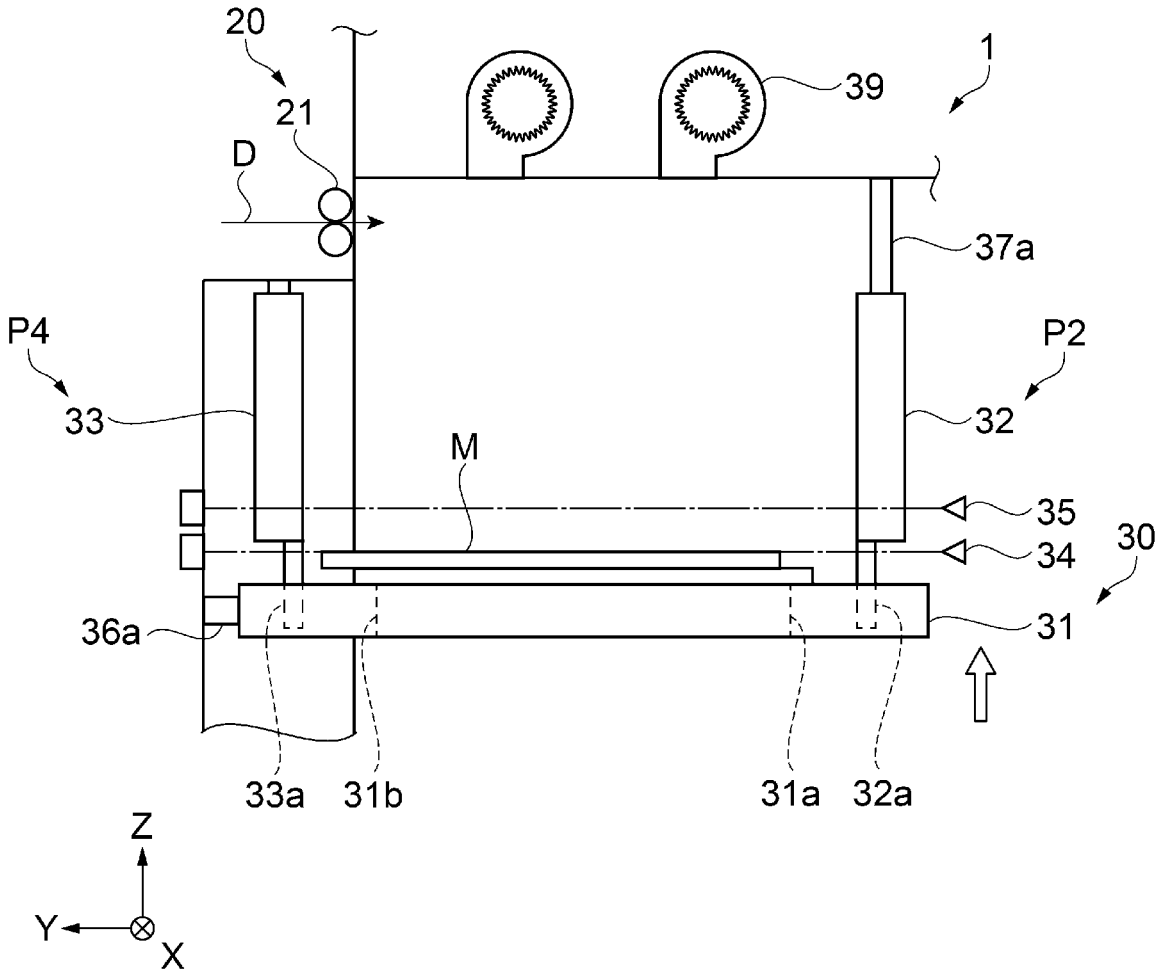
FIG. 10 is still another schematic diagram for explaining the placement defect resolution process in the second embodiment.

Next, as shown in FIG. 10, the control section 93 controls the stacking platform drive section 36 to move the stacking platform 31 in the +Z direction, as shown by a white arrow. The control section 93 raises the stacking platform 31 to a position where a position of the detection light from the top surface detection sensor 34 and a position of the top surface of the stacked medium M become the same in the Z-axis direction.

Figure 11:
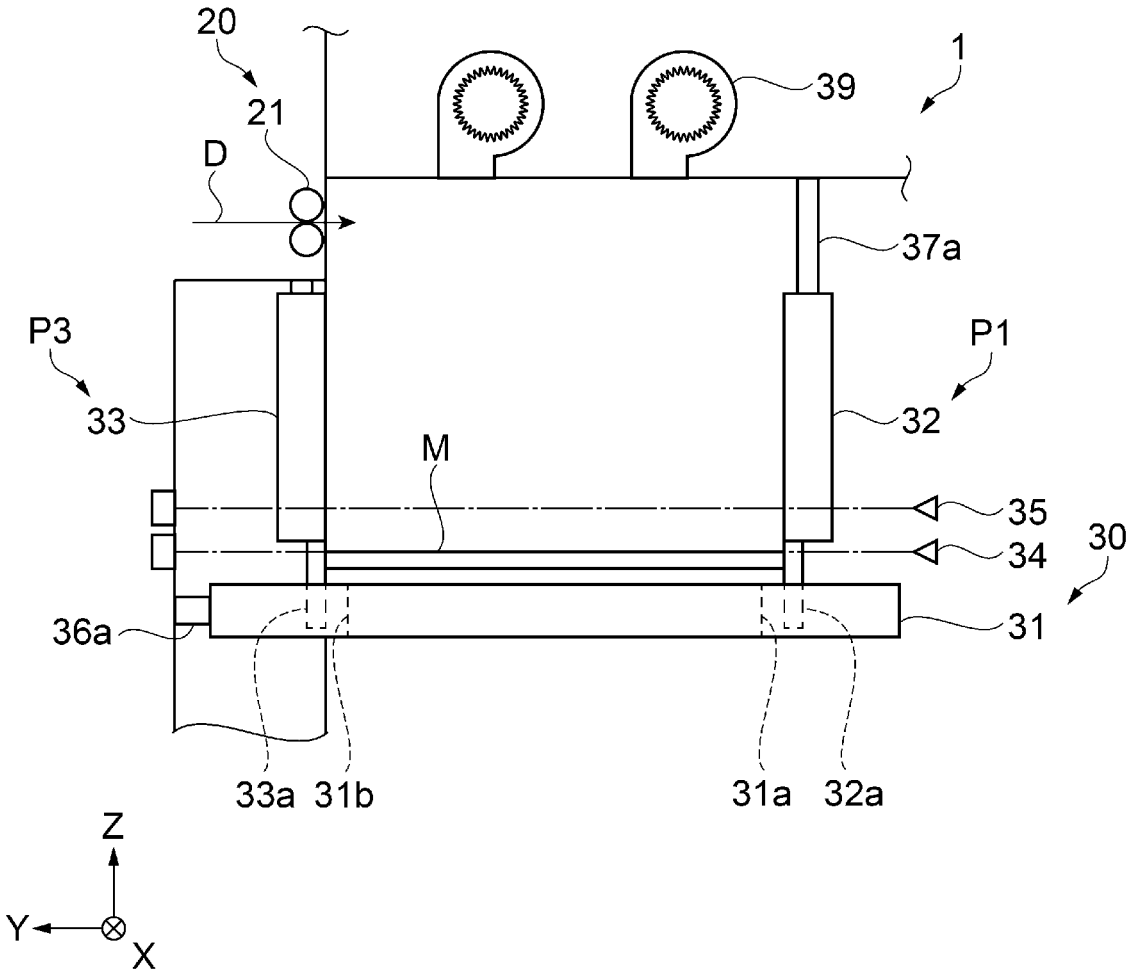
FIG. 11 is a further schematic diagram for explaining the placement defect resolution process in the second embodiment.

Next, as shown in FIG. 11, the control section 93 controls the fence drive section 37 to move the first movable fence 32 and the second movable fence 33 from the retreat positions P2 and P4 to the restriction positions P1 and P3. By this, the medium M, which is no longer leaning on the second movable fence 33, is moved to the stacking position by the second movable fence 33. Further, the control section 93 controls the fence drive section 37 to move the third movable fence 42 and the fourth movable fence 43 from the retreat positions P6 and P8 to the restriction positions P5 and P7.

3. Third Embodiment

The media stacking device 30 and the printing system 1 in a third embodiment differ from the medium stacking device 30 and the printing system 1 in the above embodiments in the placement defect resolution process, which is performed in step S3 of the flowchart in FIG. 3. The configuration of the medium stacking device 30 and the printing system 1 in the third embodiment is the same as that of the medium stacking device 30 and the printing system 1 in the first embodiment.

Next, the placement defect resolution process, which is performed by the medium stacking device 30 and the printing system 1 in this embodiment in step S3 of the flowchart in FIG. 3, is described. In this embodiment, the sequence of processes in the placement defect resolution process executed by the control section 93 when the medium M is placed on the stacking platform 31, corresponds to the control method of the medium stacking device 30. Note that when the control section 91 of the printing device 10 controls the entire printing system 1 in conjunction with the control section 92 and the control section 93, the sequence of processes executed by the control section 93 below correspond to the control method of the printing system 1.

In this embodiment, as in the first embodiment, if it is determined in step S1 that there is a placement defect of the medium M on the stacking platform 31, the control section 93 executes the placement defect resolution process.

Depending on the combination of the paper type of the medium M and the print specifications of the image to be printed on the medium M, the discharged medium M may deform on the stacking platform 31, and it may be determined that there is a placement defect of the medium M on the stacking platform 31.

Figure 13:
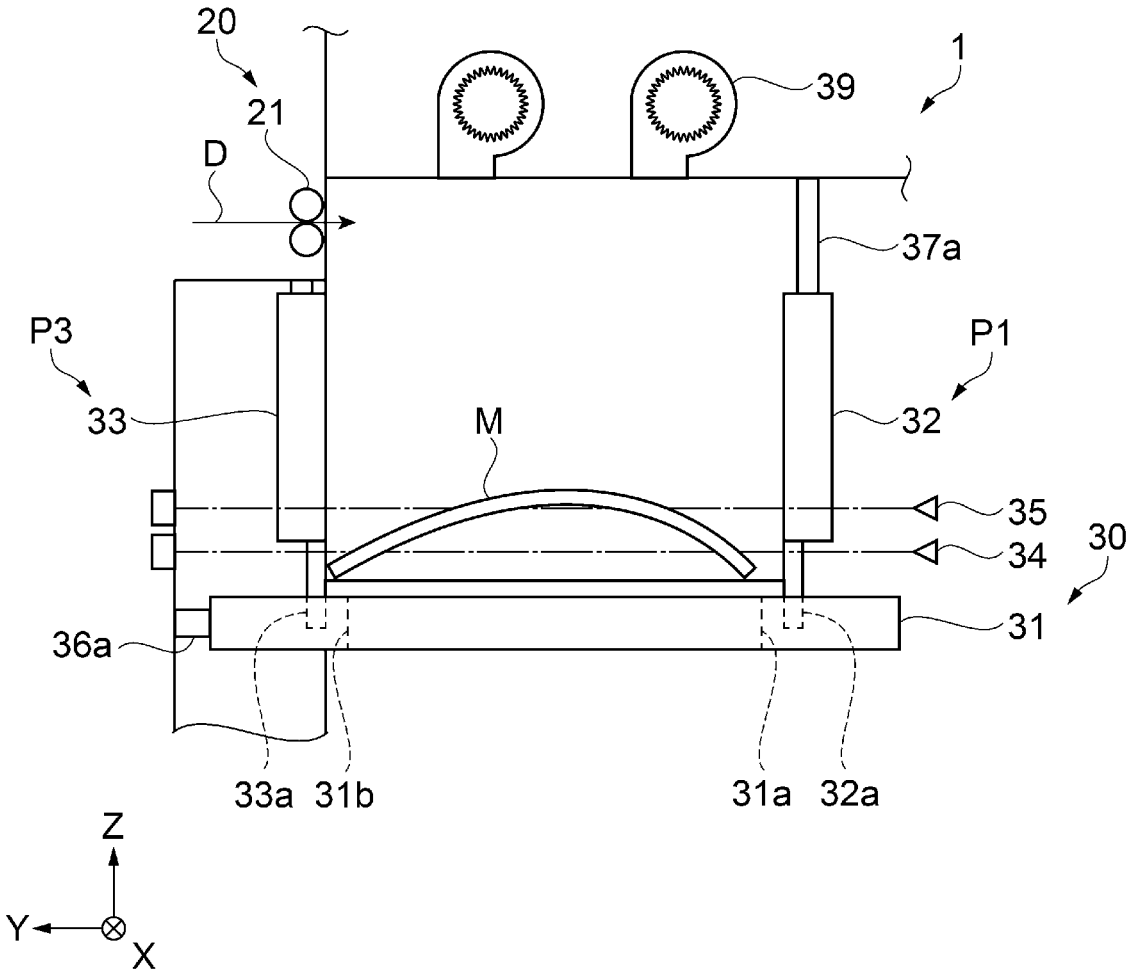
FIG. 13 is a schematic diagram for explaining the placement defect resolution process in a third embodiment.

For example, as shown in FIG. 13, when the discharged medium M curls on the stacking platform 31 in such a way that the center of the medium M is convex in the +Z direction with respect to the edge portion of the medium M, it may be determined that there is a placement defect of the medium M on the stacking platform 31. If it is double-sided printing, this type of curl tends to occur when the print duty on the −Z direction side, which is the bottom surface of the medium M, is higher than the print duty on the +Z direction side, which is the top surface of the medium M. Further, if it is single-sided printing, this type of curl tends to occur when the medium M is placed with the image printed surface down. The curl appears more noticeable when the difference in print duty at the front surface and the back surface of the medium M is higher than 30%.

Therefore, in the placement defect resolution process in this embodiment, the control section 93 estimates whether the medium M on the stacking platform 31 is curled or not, based on the medium information of the medium M and the printing information of the image printed on the medium M. The medium information of the medium M in this case is, for example, the paper type of the medium M. The printing information in this case is, for example, the print duty and whether double-sided printing is selected or not. Then, if the control section 93 determines that the medium M is curled on the stacking platform 31 in such a way that the center of the medium M is convex in the +Z direction with respect to the edge portion of the medium M, the control section 93 drives the fan 39 in the placement defect resolution process.

In this embodiment of the placement defect resolution process, first, the control section 93 also determines the movement amount MA of the movable fence MF from the restriction position to the retreat position based on the medium information of the medium M and the printing information of the image printed on the medium M. Once the movement amount MA is determined, the retreat position of the movable fence MF is determined. Based on the medium information of the medium M and the printing information of the image printed on the medium M, the control section 93 estimates whether the medium M is curled on the stacking platform 31 in such a way that the center of the medium M is convex in the +Z direction with respect to the edge portion of the medium M.

Figure 14:
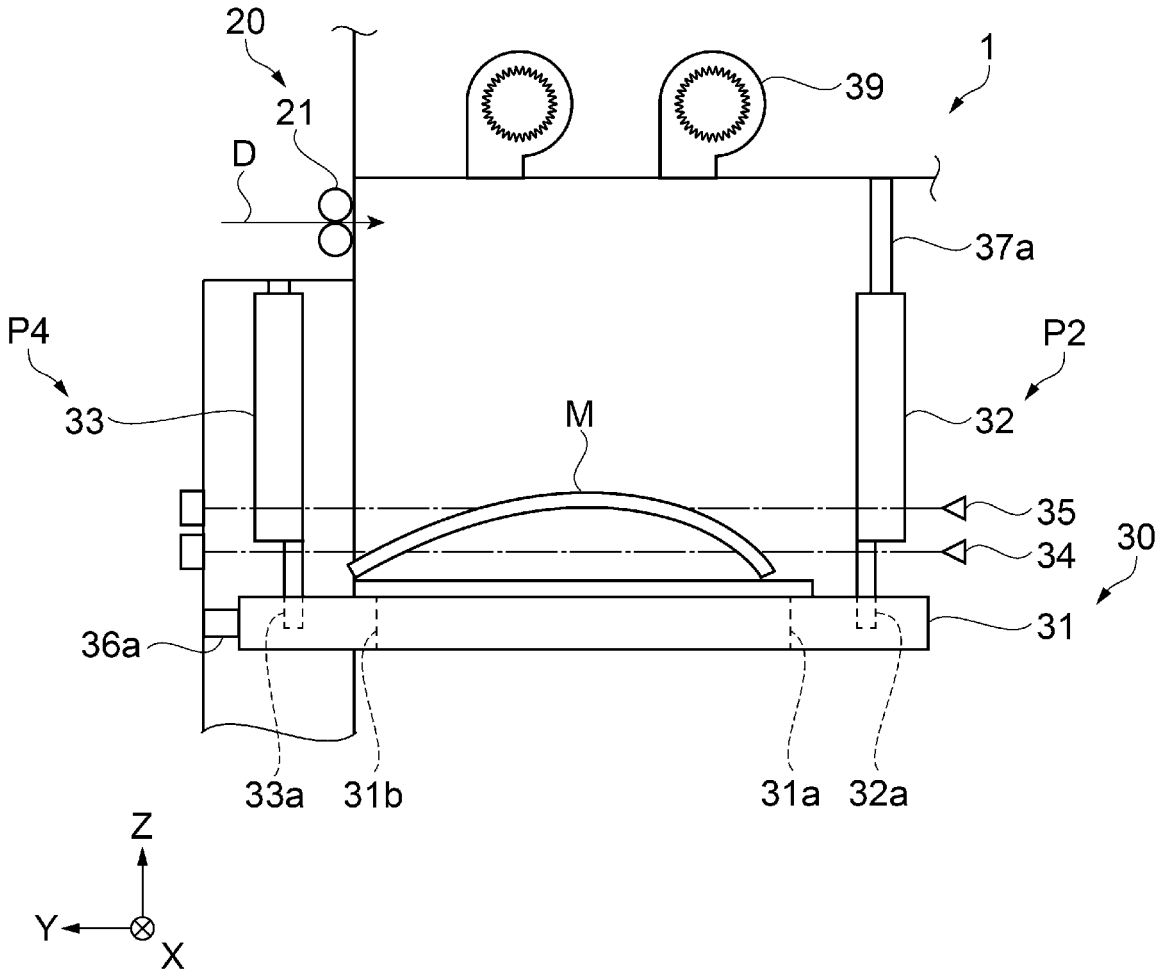
FIG. 14 is another schematic diagram for explaining the placement defect resolution process in the third embodiment.

Next, the control section 93 controls the fence drive section 37 to move the first movable fence 32 and the second movable fence 33 from the restriction positions P1 and P3, shown in FIG. 13, to the retreat positions P2 and P4, shown in FIG. 14. Further, the control section 93 controls the fence drive section 37 to move the third movable fence 42 and the fourth movable fence 43 (not shown) from the restriction positions P5 and P7 to the retreat positions P6 and P8. If the control section 93 determines, based on the medium information of medium M and the printing information of the image printed on medium M, that the medium M is curled in such a way that the center of medium M is convex in the +Z direction with respect to the edge portion of medium M, the control section 93 starts driving the fan 39.

Figure 15:
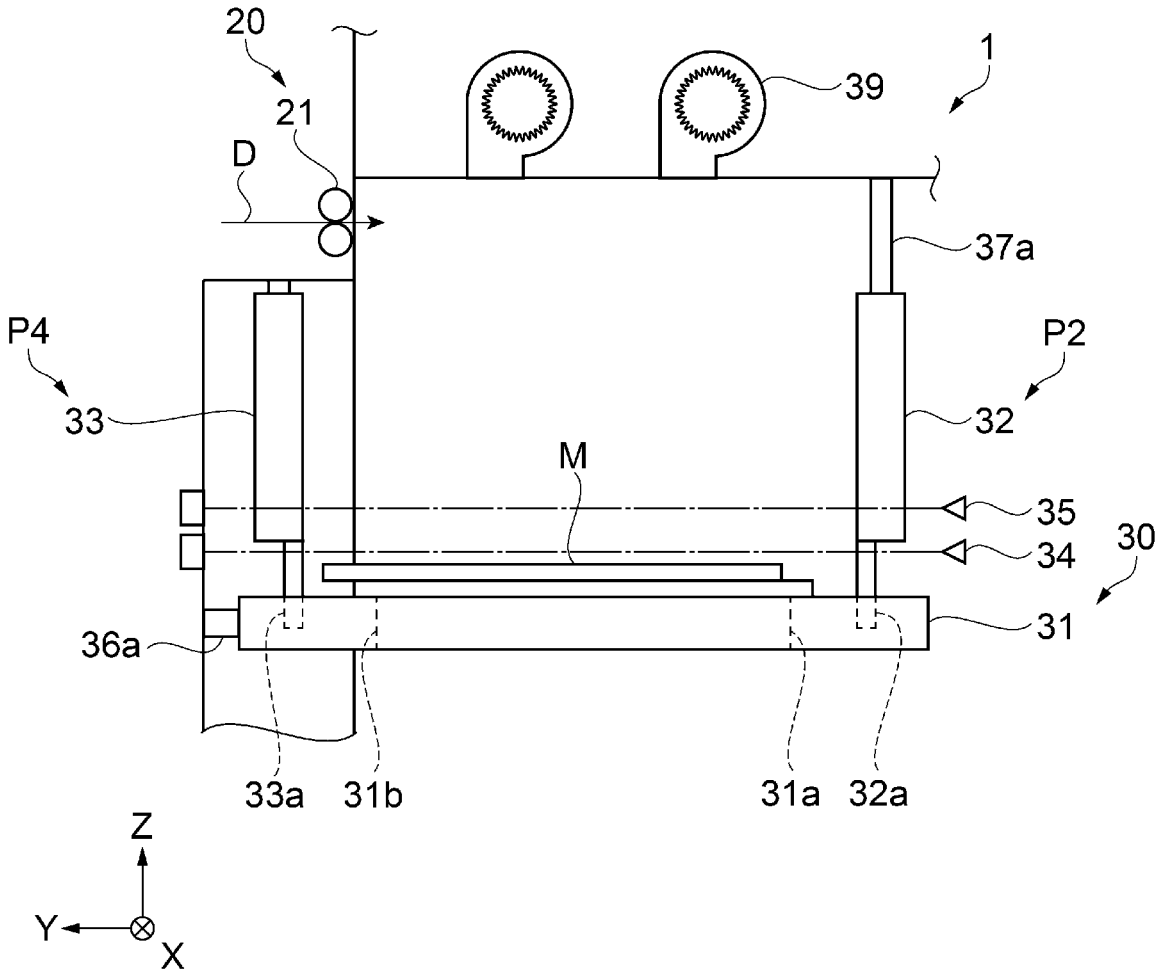
FIG. 15 is still another schematic diagram for explaining the placement defect resolution process in the third embodiment.

When the fan 39 is driven, air is blown from the fan 39 toward the medium M, which is in the −Z direction, and a force that pushes the medium M toward the stacking platform 31 is applied to the medium M. By this, the curl of the medium M is reduced, as shown in FIG. 15. The control section 93 drives the fan 39 for a predetermined time and then stops driving the fan 39. Note that the drive time of the fan 39 may be changed depending on the degree of the curl of the medium M. For example, if the degree of the curl of the medium M is relatively large, the drive time of the fan 39 is set longer than if the degree of the curl of the medium M is relatively small. In this case, the control section 93 changes the drive time of the fan 39 based on the medium information of the medium M and the printing information of the image printed on the medium M.

Further, blowing power of the fan 39 may be changed depending on the degree of the curl of the medium M. For example, if the degree of the curl of the medium M is relatively large, the blowing power of the fan 39 is set higher than if the degree of the curl of the medium M is relatively small. In this case, the control section 93 changes the blowing power of the fan 39 based on the medium information of the medium M and the printing information of the image printed on the medium M. The temperature of the air blown from the fan 39 may be changed depending on the degree of the curl of the medium M. For example, if the degree of the curl of the medium M is relatively large, the temperature of the air to be blown is set higher than if the degree of the curl of the medium M is relatively small. In this case, the control section 93 changes the temperature of the air blown from the fan 39 based on the medium information of the medium M and the printing information of the image printed on the medium M.

Figure 16:
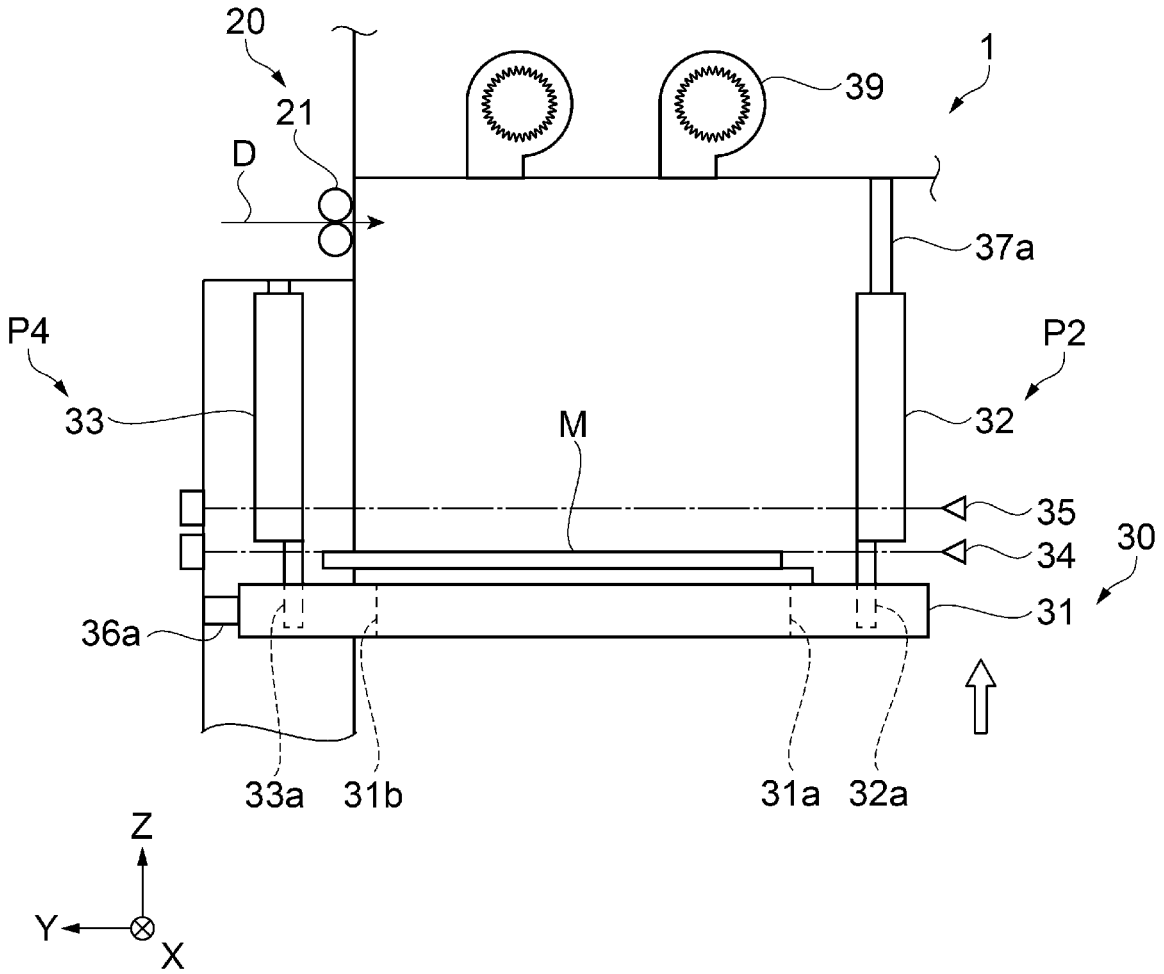
FIG. 16 is a further schematic diagram for explaining the placement defect resolution process in the third embodiment.

Next, as shown in FIG. 16, the control section 93 controls the stacking platform drive section 36 to move the stacking platform 31 in the +Z direction, as indicated by the white arrow. The control section 93 raises the stacking platform 31 to a position where a position of the detection light from the top surface detection sensor 34 and a position of the top surface of the stacked medium M become the same in the Z-axis direction.

Figures 17, 18:
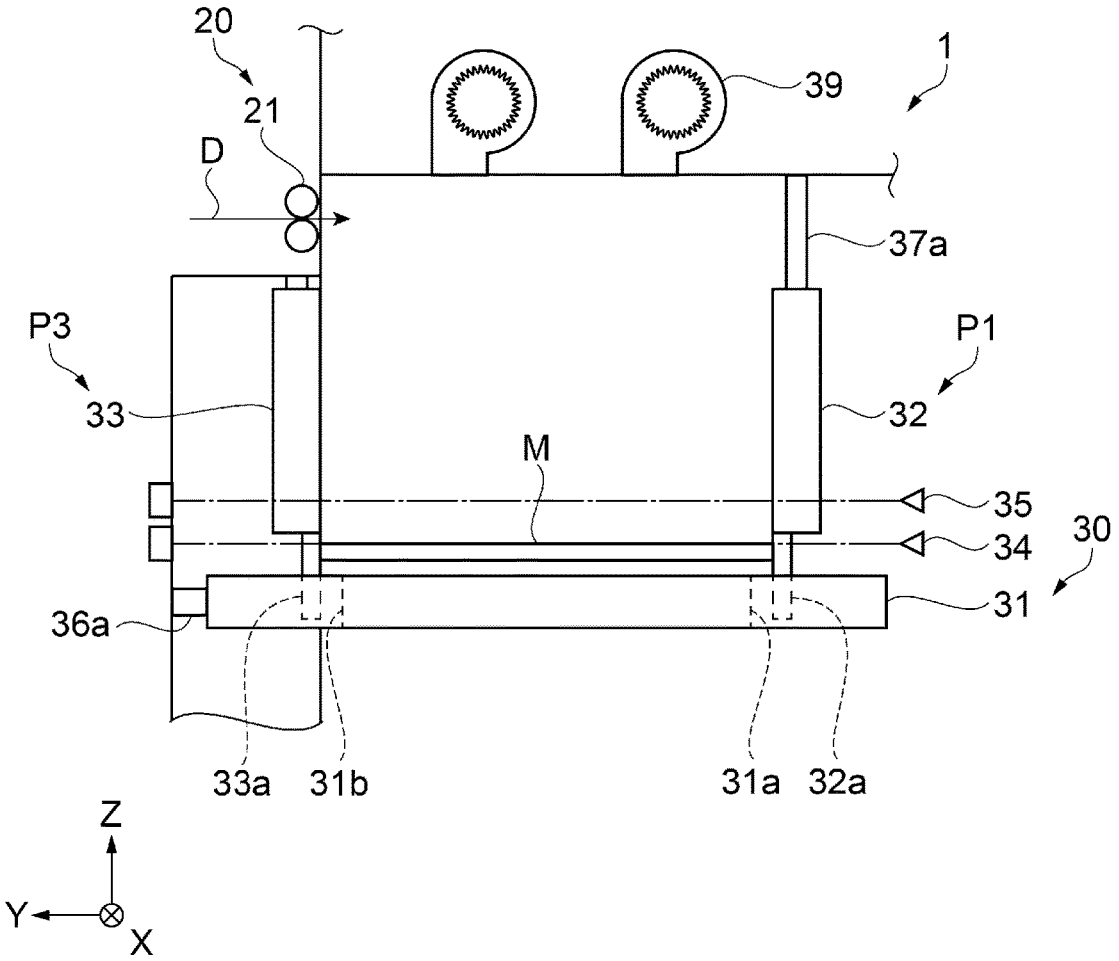
FIG. 17 is another further schematic diagram for explaining the placement defect resolution process in the third embodiment.
FIG. 18 is a diagram for explaining a set value for setting a movement amount of the movable fence.

Next, as shown in FIG. 17, the control section 93 controls the fence drive section 37 to move the first movable fence 32 and the second movable fence 33 from the retreat positions P2 and P4 to the restriction positions P1 and P3. By this, the curl-reduced medium M is moved to the stacking position by the second movable fence 33. Further, the control section 93 controls the fence drive section 37 to move the third movable fence 42 and the fourth movable fence 43 from the retreat positions P6 and P8 to the restriction positions P5 and P7.

As described above, the medium stacking device 30 according to the third embodiment can achieve the following effects.

The medium stacking device 30 has the fan 39, which is located above the stacking platform 31 and can blow air toward the medium M, and when a placement defect of the medium M is detected, the control section 93 drives the fan 39. According to this, even if the placement defect of the medium M is detected, for example, due to deformation caused by the curl of the medium M, the placement defect of the medium M on the stacking platform 31 can be resolved.

The medium stacking device 30 in the above embodiment of this disclosure is based on the configuration described above, but it is of course possible to change or omit portions of the configuration to the extent that it does not depart from the gist of this disclosure. Further, the printing system 1 in the above embodiment of this disclosure is based on the configuration described above, but it is of course possible to change or omit portions of the configuration to the extent that it does not depart from the gist of this disclosure. Further, the control method of the medium stacking device 30 in the above embodiment of this disclosure is based on the configuration described above, but it is of course possible to change or omit portions of the configuration to the extent that it does not depart from the gist of this disclosure. Further, the above embodiments and other embodiments described below may be combined with each other to the extent that they are not technically inconsistent. Other embodiments will be described below.

In the above embodiment, the movement amount MA of the first movable fence 32 from the restriction position P1 to the retreat position P2 and the movement amount MA of the second movable fence 33 from the restriction position P3 to the retreat position P4 need not be the same. For example, the movement amount MA of the first movable fence 32 may be greater than the movement amount MA of the second movable fence 33. Further, the movement amount MA of the third movable fence 42 from the restriction position P5 to the retreat position P6 may not be the same as either the movement amount MA of the first movable fence 32 or the movement amount MA of the second movable fence 33. For example, the movement amount MA of the third movable fence 42 may be smaller than the movement amount MA of the first movable fence 32 and the movement amount MA of the second movable fence 33. In this case, the movement amount MA of the third movable fence 42 may be the same as the movement amount MA of the fourth movable fence 43 from the restriction position P7 to the retreat position P8. In this case, the set values dn for setting the respective movement amounts MA of the first movable fence 32, the second movable fence 33, the third movable fence 42, and the fourth movable fence 43 may be stored in storage section 93*b* or storage section 91*b*.

In the above embodiment, the printing system 1 may not have the control sections 92 and 93. The control section 91 may control the entire printing system 1. For example, in the above embodiment, the control section 91 performs the control that the control section 93 performs when the medium M is placed on the stacking platform 31 of the medium stacking device 30. In this case, the set values for adjusting the timing for detecting the placement defect of the medium M on the stacking platform 31, the set value dn for setting the movement amount MA, and the like are stored in the storage section 91*b*.

In the above embodiment, either the third movable fence 42 or the fourth movable fence 43 may not be movable.

In the above embodiment, after executing the placement defect resolution process in the flowchart in FIG. 3, the control section 93 may confirm again whether there is the placement defect of the medium M on the stacking platform 31. If the placement defect of the medium M on the stacking platform 31, including leaning of medium M against the movable fence MF, is detected, the control section 93 may execute the placement defect resolution process. In this case, the control section 93 may drive the fan 39 in the placement defect resolution process. By this, the edge portion of the medium M may be pressed against the stacking platform 31, thereby facilitating the resolution of leaning of the medium M against the movable fence MF. Note that in this case, the control section 93 may drive the fan 39 while the movable fence MF is in the restriction position.

In the above embodiment, the pair of fans 39, which are located above the stacking platform 31 and spaced apart in the Y-axis direction, may not be arranged three spaced apart in the X-axis direction. For example, one fan 39 may be located above the stacking platform 31.

In the above embodiment, the pair of fans 39, which are located above the stacking platform 31 and spaced apart in the Y-axis direction, may not be arranged three spaced apart in the X-axis direction. For example, at positions above the stacking platform 31, three fan rows may be arranged spaced apart in the X-axis direction, wherein each fan row is formed by three fans 39 spaced apart in the Y-axis direction. Assume, for example, that the medium M discharged on the stacking platform 31 is curled so that the center of the medium M is convex in the −Z direction with respect to both edge portions of the medium M in the Y-axis direction, and that it is determined that there is the placement defect of the medium M on the stacking platform 31. In this case, of the nine fans 39, the control section 93 may drive the six fans 39 that form both end fan rows in the Y-axis direction, with the movable fence MF positioned in the retreat position. By this, the curl of the medium M may be reduced by applying a force to the medium M that pushes the both ends of the medium M in the Y-axis direction toward the stacking platform 31.

In the above embodiment, the medium stacking device 30 does not need to be equipped with the fan 39 if there is little curl or other deformation that occurs in the medium M as a result of printing images.

What is claimed is:

1. A medium stacking device comprising:

a stacking platform that is configured to have stacked thereon a medium on which an image is printed by ejecting liquid;

a movable fence that moves between a restriction position that restricts an edge portion of the medium that was discharged toward the stacking platform, and a retreat position retreated from the restriction position; and a control section that, when a placement defect of the medium is detected in the stacking platform, performs control to move the movable fence from the restriction position to the retreat position and to return the movable fence to the restriction position, wherein the control section determines a movement amount from the restriction position to the retreat position based on medium information of the medium and printing information of the image.

2. The medium stacking device according to claim 1, wherein the medium information is at least one of a paper type, a size, a basis weight, a paper quality, a discharge speed, and a discharge interval of the medium.

3. The medium stacking device according to claim 2, wherein the medium information is the paper type, and the printing information is a print duty at a time when the image is printed on the medium.

4. The medium stacking device according to claim 1, wherein the movable fence includes a first movable fence and a second movable fence, and the second movable fence is provided at a first position so that the second movable fence and the first movable fence sandwich the medium therebetween with respect to a discharge direction in which the medium is discharged.

5. The medium stacking device according to claim 4, wherein the movable fence includes a third movable fence and a fourth movable fence, and the third movable fence is provided at a second position so that the third movable fence and the fourth movable fence sandwich the medium therebetween with respect to a direction that intersects the discharge direction.

6. The medium stacking device according to claim 1, further comprising:

a fan that is located above the stacking platform, wherein the fan is configured to blow air toward the medium, and when the placement defect of the medium is detected, the control section drives the fan.

7. The medium stacking device according to claim 1, wherein the stacking platform is configured to rise and lower.

8. The medium stacking device according to claim 1, wherein the control section adjusts a detection timing of the placement defect of the medium based on the medium information and the printing information.

9. A printing system comprising:

the medium stacking device according to claim 1 on which is stacked the medium on which the image is printed; and a printing device that prints the image by ejecting the liquid onto the medium.

10. A control method of a medium stacking device including a stacking platform that is configured to have stacked thereon a medium on which an image is printed by ejecting liquid, and a movable fence that moves between a restriction position that restricts an edge portion of the medium that was discharged toward the stacking platform, and a retreat position retreated from the restriction position, the control method of the medium stacking device comprising:

confirming whether or not there is a placement defect of the medium being stacked on the stacking platform;

determining a movement amount from the restriction position to the retreat position based on medium information of the medium and printing information of the image, when the placement defect of the medium is detected; and moving the movable fence from the restriction position to the retreat position, and returning the movable fence to the restriction position, based on the determined movement amount.

* * * * *